US007527363B2

(12) United States Patent
Nagashima

(10) Patent No.: US 7,527,363 B2
(45) Date of Patent: May 5, 2009

(54) DISCHARGE HEAD OF IMAGE FORMING APPARATUS WITH PIEZOELECTRIC BODY FOR GENERATING AND SENSING PRESSURE

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 321 days.

(21) Appl. No.: 11/180,708

(22) Filed: Jul. 14, 2005

(65) Prior Publication Data

US 2006/0012645 A1 Jan. 19, 2006

(30) Foreign Application Priority Data

Jul. 16, 2004 (JP) ..... 2004-210259

(51) Int. Cl.
*B41J 2/45* (2006.01)
*B41J 29/393* (2006.01)
*B21D 53/76* (2006.01)

(52) U.S. Cl. ..... 347/70; 347/19; 252/62.9 PZ; 29/890.1

(58) Field of Classification Search ..... 347/68
See application file for complete search history.

(56) References Cited

U.S. PATENT DOCUMENTS

| | | | | |
|---|---|---|---|---|
| 4,293,867 | A * | 10/1981 | Isayama | 347/92 |
| 4,498,088 | A * | 2/1985 | Kanayama | 347/92 |
| 4,695,852 | A * | 9/1987 | Scardovi | 347/92 |
| 4,709,360 | A * | 11/1987 | Martin et al. | 310/317 |
| 6,419,848 | B1 * | 7/2002 | Qiu et al. | 252/62.9 R |
| 7,249,818 | B1 * | 7/2007 | Paasch | 347/19 |
| 2005/0134657 | A1 * | 6/2005 | Kawamura | 347/71 |

FOREIGN PATENT DOCUMENTS

EP 1013453 A2 * 6/2000

(Continued)

OTHER PUBLICATIONS

K. Sumi et al., "Structural, compositional and piezoelectric properties of the sol-gel Pb(Zr0.56Ti0.44)0.80(Mg1/3Nb2/3)0.20)O3/Pb(Zr0.56Ti0.44)O3 composite films," Thin Solid Films 349 (1999), pp. 270-275.*

Machine translation of patent document JP 2000022233 A to Oka et al.*

*Primary Examiner*—Luu Matthew
*Assistant Examiner*—Shelby Fidler
(74) *Attorney, Agent, or Firm*—Birch, Stewart, Kolasch & Birch, LLP

(57) ABSTRACT

The discharge head comprises: a nozzle plate having a discharge aperture through which a droplet of liquid is discharged onto a discharge receiving medium; a pressure chamber which stores the liquid discharged from the discharge aperture; a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein: the piezoelectric element is formed integrally by distributing a first piezoelectric body section and a second piezoelectric body section unevenly in a plane parallel to the diaphragm; the first piezoelectric body section causes the diaphragm to deform for applying the discharge pressure to the liquid stored in the pressure chamber, the first piezoelectric body section being made of a first constituent material; and the second piezoelectric body section determines a pressure generated in the pressure chamber, the second piezoelectric body section being made of a second constituent material.

36 Claims, 15 Drawing Sheets

FOREIGN PATENT DOCUMENTS

| | | | | |
|---|---|---|---|---|
| JP | 55-118878 | A | | 9/1980 |
| JP | 63095948 | A | * | 4/1988 |
| JP | 63122549 | A | * | 5/1988 |
| JP | 11-238920 | A | | 8/1999 |
| JP | 2000-22233 | A | | 1/2000 |
| JP | 2001-129993 | A | | 5/2001 |

* cited by examiner

DISCHARGE HEAD OF IMAGE FORMING APPARATUS WITH PIEZOELECTRIC BODY FOR GENERATING AND SENSING PRESSURE

BACKGROUND OF THE INVENTION

1. Field of the Invention

The present invention relates to a discharge head and an image forming apparatus, and more particularly to a structure and manufacturing technology for a piezoelectric element which is used in a discharge head contained in an image forming apparatus such as an inkjet recording apparatus.

2. Description of the Related Art

Conventionally, as one example of an image forming apparatus, an inkjet recording apparatus is known in which comprises an inkjet head (a discharge head, or a discharge head) having an arrangement of a plurality of nozzles (discharge elements), which records images on an image forming medium by discharging ink from the nozzles while causing the inkjet head and an image forming medium (a discharge receiving medium) to move relatively to each other.

There are various ink discharge methods for inkjet heads in such the inkjet recording apparatuses. For example, one known method is a piezoelectric method, in which the volume of a pressure chamber is changed by causing a diaphragm forming a portion of the pressure chamber to deform due to deformation of a piezoelectric element, ink being introduced into the pressure chamber from an ink supply passage when the volume is increased, and the ink inside the pressure chamber being discharged as a droplet from the nozzle when the volume of the pressure chamber is reduced. Another known method is a thermal inkjet method, in which ink inside an ink chamber (a pressure chamber) is heated to generate a bubble in the ink, and ink is then discharged by means of the expansive energy created as the bubble grows.

In an inkjet head comprising piezoelectric elements as pressure elements which apply a discharge pressure to the ink inside the pressure chambers, the materials, structure, shape, and the like, of the pressure chambers, piezoelectric elements, and other parts, are designed variously, for instance, layers having components of different compositions or mixed layers comprising a combination of a plurality of components are used in piezoelectric elements having a multiple-layer structure, in order to be able to ensure satisfactory discharge of ink, even when using ink of high viscosity which requires a large discharge pressure, by applying the discharge pressure to the ink inside the pressure chambers with good efficiency.

In an inkjet recording apparatus, if gas bubbles occur inside the inkjet head due to infiltration of air, or change in the temperature of the ink, then the change in volume of the pressure chambers is absorbed by the gas bubbles, and hence it is not possible to impart a sufficient discharge pressure to the ink and discharge abnormalities in which ink discharge is incomplete may arise. Furthermore, a discharge failure in which no ink droplet is discharged from the nozzle may arise in the case of blocking a nozzle by drying of the ink in the vicinity of the nozzles or due to foreign material, such as dirt, or the like, or in the case of failure to replenish ink into the pressure chamber.

The occurrence of discharge abnormalities or discharge failures of these kinds reduces the performance of the inkjet head, and causes abnormalities in the shape (size or form) of the dots formed on the image forming medium, or omission of such dots, thus leading to a decline in the quality of the image formed on the image forming medium. Therefore, image quality can be maintained by rapidly determining the occurrence of a discharge abnormality or discharge failure and performing maintenance, such as purging, at the nozzle producing the discharge abnormality or discharge failure, thereby ensuring that ink droplets are discharged in a desirable state from each of the nozzles.

Conventionally, methods for determining various kinds of discharge abnormalities and discharge failures have been proposed, such as a method for determining the occurrence of a discharge abnormality or discharge failure such as that described above, from the state of the pressure (vibration) inside the pressure chamber, or a method for determining the occurrence of a discharge abnormality or discharge failure from the image (dots) formed on the image forming medium.

The ink discharge apparatus disclosed in Japanese Patent Application Publication No. 55-118878 is an ink discharge apparatus in which a portion of the walls forming an ink chamber having an ink supply port by which ink is supplied from an ink tank and an ink droplet discharge port by which ink is propelled as a particle is constituted by a vibrating element which causes the volume of the ink chamber to change by being displaced in response to an electrical signal, which comprises a determination device for determining the state of displacement of the vibrating element so as to detect an abnormality in the displacement state of the vibrating element with respect to the electrical signal. Since a high-frequency wave is superimposed on the electrical signal which determines the displacement state, when there is a discharge failure, then a discharge abnormality is judged to have occurred when a high-frequency wave component is included in this electrical signal.

Furthermore, in the piezoelectric element, inkjet recording head and manufacturing method thereof disclosed in Japanese Patent Application Publication No. 11-238920, piezoelectric elements are constituted by laminating together a plurality of piezoelectric thin films between an upper electrode film and a lower electrode film. In this piezoelectric element, microcrystalline particles are dispersed within the respective piezoelectric thin films. In addition, the surface density of the microcrystalline particles in the respective piezoelectric thin films tends to decrease, as the distance increases from the piezoelectric thin film which is in contact with the lower electrode film. If microcrystalline particles which are different to the original crystals are grown in the respective layers of a piezoelectric body comprising a plurality of layers, and if the piezoelectric element is composed in such a manner that the density of microcrystalline particles declines toward the upper side layer, then the microcrystalline particles alleviate the internal stress. Therefore, since the piezoelectric body can be formed as a thick film, it is possible to improve the reliability thereof.

Furthermore, in the inkjet printer head disclosed in Japanese Patent Application Publication No. 2001-129993, a method of forming a film by blowing fine particles onto a substrate from a fine nozzle at a high speed of several hundred m/sec. (namely, aerosol deposition, or AD), is adapted as the method of forming the piezoelectric elements of the inkjet printer, for manufacturing inkjet drive elements to an optimal film thickness accurately in a short period of time.

Moreover, the piezoelectric thin film element disclosed in Japanese Patent Application Publication No. 2000-22233, comprises a piezoelectric film sandwiched between an upper electrode and a lower electrode. This piezoelectric film has a structure composed of a plurality of components in which regions that are adjacent in the direction perpendicular to the thickness of the film (the width direction) have mutually different compositions. By adjusting the ratio occupied by each of the respective components constituting the piezoelectric films in the piezoelectric film, it is possible to adjust the dielectric constant and the piezoelectric g constant of the piezoelectric film, and hence the piezoelectric $d_{31}$ constant can be improved in comparison with a piezoelectric body having a simple composition.

As described above, the inkjet heads relating to the conventional technology are disclosed as a technology for improving discharge efficiency by generating a force from a piezoelectric body with good efficiency, or as a technology for improving reliability by reducing the internal stress of the piezoelectric body and the peripheral members. However, the inkjet heads relating to the conventional technology are not disclosed as a technology for forming drive elements (pressure elements) which serve to eject ink and determination elements which serve to determine the ink discharge state as integral bodies, and as a technology for improving both discharge efficiency and determination efficiency, in an inkjet head that is integrated to a high density.

In the ink discharge device disclosed in Japanese Patent Application Publication No. 55-118878, a portion of a vibrating element (drive element) constitutes a determination element which determines the displacement of the vibrating element (i.e., the vibrating element has a structure in which drive elements and determination elements are arranged on a diaphragm plate). Since those elements have independent electrical connections respectively, it is not suitable for a high-density structure.

In the piezoelectric element, inkjet recording head and manufacturing method thereof disclosed in Japanese Patent Application Publication No. 11-238920, the piezoelectric element has a structure which comprises different compositions, and the like, in the thickness direction of the piezoelectric body, so that the drive properties (the properties relating to ink discharge) can be improved. However, when the piezoelectric body serves both to drive ink discharge and to determine the state of discharge, there is no disclosure regarding a suitable method.

In the inkjet printer head disclosed in Japanese Patent Application Publication No. 2001-129993, the AD method is disclosed as a technology for forming drive elements (piezoelectric bodies), but there is no particular disclosure regarding the determination of the discharge condition.

In the piezoelectric thin film element disclosed in Japanese Patent Application Publication No. 2000-22233, since the piezoelectric thin film element has a structure comprising different compositions, and the like, in a direction perpendicular to the thickness direction of the drive elements, it is possible to improve the drive properties (the properties relating to ink discharge) as a similar to the inkjet recording head and manufacturing method thereof described in Japanese Patent Application Publication No. 11-238920. However, when the piezoelectric body serves both to drive ink discharge and to determine the discharge condition, there is no disclosure regarding a suitable method.

SUMMARY OF THE INVENTION

The present invention is contrived in view of such circumstances, and an object thereof is to provide a discharge head and an image forming apparatus which achieve both efficiency of liquid droplet discharge and efficiency of discharge abnormality determination, relating to a discharge head that is integrated to a high density.

In order to attain the aforementioned object, the present invention is directed to a discharge head comprising: a nozzle plate having a discharge aperture through which a droplet of liquid is discharged onto a discharge receiving medium; a pressure chamber which stores the liquid discharged from the discharge aperture; a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein: the piezoelectric element is formed integrally by distributing a first piezoelectric body section and a second piezoelectric body section unevenly in a plane parallel to the diaphragm; the first piezoelectric body section causes the diaphragm to deform for applying the discharge pressure to the liquid stored in the pressure chamber, the first piezoelectric body section being made of a first constituent material; and the second piezoelectric body section determines a pressure generated in the pressure chamber, the second piezoelectric body section being made of a second constituent material.

According to the present invention, a piezoelectric element is formed integrally by distributing a first constituent material and a second constituent material which have different properties in an uneven fashion in the planar direction of the piezoelectric element. The first piezoelectric body section made of the first constituent material contributes to discharged liquid droplets with efficiency. On the other hand, the second piezoelectric body section made of the second constituent material contributes to determine the pressure in the pressure chamber with efficiency. Therefore, both liquid discharge properties and pressure determination properties are good, and a piezoelectric element suitable for high-density arrangement can be formed.

As a compositional example of a discharge head described above, it is possible to adopt a full line type head, which has a nozzle row that a plurality of nozzles for discharging ink are arranged through a length corresponding to the full width of the discharge receiving medium.

In this case, there is a mode in which a plurality of relatively short discharge head blocks having nozzles rows which do not reach a length corresponding to the full width of the discharge receiving medium are combined and joined together so as to form nozzle rows of a length that correspond to the full width of the discharge receiving medium.

A full line type head is usually disposed in a direction that is perpendicular to the relative feed direction (relative conveyance direction) of the discharge receiving medium. However, there is also a mode in which the inkjet head is disposed following an oblique direction that forms a prescribed angle with respect to the direction perpendicular to the conveyance direction.

A "discharge head" may include devices known as an "inkjet head", a "print head", or the like, which are used in image forming apparatuses, such as inkjet recording apparatuses.

A "discharge receiving medium" indicates a medium which receives liquid droplets discharged from the discharge head (this medium may also be called a print medium, image forming medium, recording medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of a discharge head, and the like.

The present invention is also directed to the discharge head wherein: the first constituent material contains a constituent material which forms a piezoelectric body section having a high absolute value for an equivalent piezoelectric constant (d constant) compared to the second constituent material; and the second constituent material contains a constituent material which forms a piezoelectric body section having a high absolute value for a voltage output coefficient (g constant) compared to the first constituent material.

According to the present invention, the equivalent piezoelectric constant (d constant) may also be called the electromechanical conversion constant, or the piezoelectric distortion constant, and indicates the magnitude of the distortion which is generated in the piezoelectric element in response to a given intensity of electrical field. A ceramic type material, or the like, may be used for the first constituent material which has a high equivalent piezoelectric constant.

In addition, the voltage output coefficient (g constant) is also known as the mechanical-electrical conversion constant or the piezoelectric stress constant, and indicates the intensity of the electrical field generated in response to a given stress. A fluoride resin type material, or the like, may be used for the second constituent material which has a high voltage output coefficient.

The piezoelectric element comprises a common electrode and an individual electrode. The individual electrode to which a drive signal is applied, and the individual electrode which obtains a determination signal may be formed as a common individual electrode. A common signal wire may be used to connect to this common individual electrode. If such the common signal wire is used, then the drive signal and the determination signal are separated electrically by a signal dividing device.

In order to attain the aforementioned object, the present invention is directed to a discharge head comprising: a nozzle plate having a discharge aperture through which a droplet of liquid is discharged onto a discharge receiving medium; a pressure chamber which stores the liquid discharged from the discharge aperture; a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein: the piezoelectric element comprises a first piezoelectric body section and a second piezoelectric body section; the first piezoelectric body section causes the diaphragm to deform for applying a discharge pressure to the liquid stored in the pressure chamber, the first piezoelectric body section being made of a first constituent material; the second piezoelectric body section determines a pressure generated in the pressure chamber, the second piezoelectric body section made of a second constituent material; and the first piezoelectric body section is disposed on a periphery of the second piezoelectric body section.

According to the present invention, a first piezoelectric body section which principally contributes to liquid discharge is provided on the periphery of a second piezoelectric body section which principally contributes to determining the pressure of the pressure chamber. Therefore, since the diaphragm undergoes greater distortion in the peripheral regions (edge regions) thereof, it is possible to obtain a large displacement of the diaphragm for the ink discharge.

The present invention is also directed to the discharge head wherein: the piezoelectric element is formed integrally by distributing the first constituent material and the second constituent material unevenly in a plane parallel to the diaphragm; the first constituent material contains a constituent material which forms a piezoelectric body section having a high absolute value for an equivalent piezoelectric constant (d constant) compared to the second constituent material; and the second constituent material contains a constituent material which forms a piezoelectric body section having a high absolute value for a voltage output coefficient (g constant) compared to the first constituent material.

Preferably, the second constituent material forms a piezoelectric element which principally determines the pressure according to a stress in a direction substantially parallel to the diaphragm.

According to the present invention, the piezoelectric elements which principally determine pressure by the stress occurring in a direction substantially perpendicular to the diaphragm include a piezoelectric element which determines pressure by means of displacement in the $g_{31}$ direction. Therefore, it is possible to determine the pressure received from the voltage (electrical field) generated in accordance with the distortion (extension or contraction) in the direction perpendicular to the direction in which the pressure is received.

Preferably, in a piezoelectric element which determines pressure according to displacement in the $g_{31}$ direction, the rigidity of the diaphragm is reduced by decreasing the thickness thereof, or the like, so that the displacement of the diaphragm is increased.

The present invention is also directed to the discharge head wherein the diaphragm comprises a low-rigidity section having a rigidity which prevents a displacement of the second piezoelectric body section from being impeded, the low-rigidity section being provided in a portion where the second piezoelectric body section is disposed.

According to the present invention, the low-rigidity section also has a rigidity which does not impair the discharge pressure transmitted from the piezoelectric element to the diaphragm during discharge of liquid.

For example, if the thickness of the diaphragm is reduced in a low-rigidity section, then the thickness may be reduced either in all or in a part of the diaphragm. If the part of the diaphragm is reduced in thickness, then preferably, the thickness is reduced in the approximate central portion of the diaphragm coinciding with the position of the piezoelectric element which principally performs pressure determination.

The present invention is also directed to the discharge head wherein the first piezoelectric body section has a structure which is laminated onto a surface of the second piezoelectric body section adjacent to the pressure chamber.

According to the present invention, a first piezoelectric body section is laminated on the diaphragm side of the second piezoelectric body section which principally performs pressure determination. Therefore, the portion providing the second piezoelectric body section which essentially functions as a pressure determination element, can contribute to the discharge of liquid.

Incidentally, the first piezoelectric body section (first constituent material) and the second piezoelectric body section (second constituent material) which form a laminated structure may have substantially the same thickness, or may have the different thicknesses. An individual electrode layer may be provided between the first piezoelectric body section and the second piezoelectric body section, and may be formed as laminated piezoelectric bodies. In this case, the polarization voltage is substantially the same on each of the piezoelectric body sections of the piezoelectric element, preferably.

In order to attain the aforementioned object, the present invention is directed to a discharge head comprising: a nozzle plate having a discharge aperture through which a droplet of liquid is discharged onto a discharge receiving medium; a pressure chamber which stores the liquid to be discharged from the discharge aperture; a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein: the piezoelectric element comprises a first piezoelectric body section and a second piezoelectric body section; the first piezoelectric body section causes the diaphragm to deform for applying a discharge pressure to the liquid stored in the pressure chamber, the first piezoelectric body section being made of a first constituent material; the second piezoelectric body section determines a pressure generated in the pressure chamber, the second piezoelectric body section being made of a second constituent material; and the second piezoelectric body section is disposed on a periphery of the first piezoelectric body section.

According to the present invention, since a second piezoelectric body section which principally contributes to determination of the pressure in the pressure chamber is provided on the periphery of a first piezoelectric body section which principally contributes to liquid discharge, it is possible to determine the pressure in the pressure chamber without affecting the liquid discharge drive characteristics.

The present invention is also directed to the discharge head wherein: the piezoelectric element is formed integrally by distributing the first constituent material and the second constituent material unevenly in a plane parallel to the diaphragm; the first constituent material contains a constituent material which forms a piezoelectric body section having a high absolute value for an equivalent piezoelectric constant (d constant) compared to the second constituent material; and the second constituent material contains a constituent material which forms a piezoelectric body section having a high absolute value for a voltage output coefficient (g constant) compared to the first constituent material.

The present invention is also directed to the discharge head wherein the second constituent material forms a piezoelectric element which principally determines the pressure according to a stress in a direction substantially perpendicular to the diaphragm.

The piezoelectric elements which principally determine pressure by the stress occurring in a direction substantially perpendicular to the diaphragm, include a piezoelectric element which determines pressure by means of displacement in the $g_{33}$ direction. Therefore, it is possible to determine the pressure received from the voltage (electrical field) which is generated in accordance with the compressive distortion in the direction perpendicular to the surface which receives the pressure.

In this case, if the pressure is determined according to displacement in the $g_{33}$ direction, then it is necessary to increase the rigidity of the piezoelectric element so as to suppress loss of pressure caused by deformation of the piezoelectric element.

The present invention is also directed to the discharge head wherein the second piezoelectric body section comprises a displacement restricting member which restricts a displacement of the second piezoelectric body section, the displacement restriction member being provided on side opposite to the pressure chamber.

According to the present invention, since a displacement restricting member which restricts the displacement of the second piezoelectric body section, is provided on the side opposite to the side which receives the pressure determined by the second piezoelectric body section which principally contributes to pressure determination, it is possible to increase the equivalent rigidity of the second piezoelectric body section, and hence deformation of the second piezoelectric body section can be suppressed.

Preferably, this displacement restricting member provide a low-rigidity section, such as a cavity section which has a rigidity which does not restrict the displacement of the piezoelectric element, in the approximate central portion which disposes the first piezoelectric body section which principally contributes to liquid discharge is disposed.

The present invention is also directed to The discharge head wherein the second piezoelectric body section is disposed in a vicinity of the discharge aperture.

According to the present invention, since the second piezoelectric body section is disposed in the vicinity of the discharge aperture, it is possible to improve the accuracy of determination of pressure abnormalities occurring in the vicinity of the discharge aperture in the pressure chamber.

The present invention is also directed to the discharge head further comprising a supply port which supplies the liquid from a liquid supply system to the pressure chamber, wherein the second piezoelectric body section is disposed in a vicinity of the supply port.

According to the present invention, since the second piezoelectric body section is disposed in the vicinity of the supply port, it is possible to improve the accuracy of determination of pressure abnormalities occurring in the vicinity of the discharge aperture in the supply port.

Incidentally, a second piezoelectric body section may be provided both in the vicinity of the discharge aperture and in the vicinity of the supply port.

The present invention is also directed to the discharge head wherein the piezoelectric element further comprises a third piezoelectric body section made of a third constituent material, the third piezoelectric body section containing a mixture of the first constituent material and the second constituent material.

According to the present invention, since a third piezoelectric body section made of a third constituent material which combines the first constituent material and the second constituent material, is provided, it is possible to prevent fractures occurring at the boundaries between the piezoelectric bodies made of different constituent materials.

Preferably, the third constituent material has a graduated structural composition that the mixture ratio between the first constituent material and the second constituent material is changed continuously and gradually.

The present invention is also directed to the discharge head wherein the piezoelectric element is manufactured by aerosol deposition.

According to the present invention, by using aerosol deposition, it is possible readily to form a structure in which different constituent materials are distributed in an uneven fashion. In addition, it is also possible readily to form a graduated structure that the mixture ratio of different constituent materials is changed continuously.

In order to attain the aforementioned object, the present invention is also directed to an image forming apparatus comprising the discharge head as described above.

The image forming apparatus may include an inkjet recording apparatus which forms color images on a print medium (discharge receiving medium) by discharging ink droplets thereto.

The present invention is also directed to the image forming apparatus further comprising a discharge abnormality judgment device which judges a discharge abnormality at the discharge aperture of the pressure chamber according to the pressure of the pressure chamber determined by the piezoelectric element.

According to the present invention, by determining the pressure in the pressure chamber, it is possible to judge an abnormality in the discharge aperture of a pressure chamber, or an abnormality on the supply side, or a discharge abnormality which occurs due to the occurrence of gas bubbles inside the pressure chamber, or the like.

A "discharge abnormality" includes a discharge failure in which a liquid droplet is not discharged even when a prescribed pressure is applied, or an abnormality in the volume of the liquid droplet discharged, or the like. Preferably, control is implemented in such a manner that a maintenance operation, such as purging or suctioning, is carried out at a discharge aperture (pressure chamber) at which a discharge abnormality has occurred.

As described above, according to the present invention, since a piezoelectric element is formed integrally by unevenly distributing a first constituent material and a second constituent material in a plane parallel to the diaphragm, it is possible to form a piezoelectric element that has different properties in different sections.

A material having a higher piezoelectric distortion constant than the second constituent material is used for the first constituent material, and the first piezoelectric body section made of the first constituent material principally drives liquid discharge. On the other hand, a material having a higher piezoelectric stress constant than the first constituent material is used for the second constituent material, and the second piezoelectric body section made of this second constituent material principally determines the pressure of the pressure chamber. By the configuration described above, it is possible to achieve a piezoelectric element which combines both liquid discharge characteristics and pressure chamber pressure determination characteristics.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3A is a plan view perspective diagram showing an example of the structure of the discharge head, FIG. 3B is an enlarged diagram of a portion of same, and FIG. 3C is a plan view perspective diagram showing a further example of the structure of the discharge head;

FIG. 4A is a cross-sectional diagram showing the three-dimensional composition of a liquid droplet discharge element, and FIG. 4B is a plan diagram showing the planar structure of a piezoelectric element;

FIG. 8A is a plan view of the ink chamber unit shown in FIG. 4A, and FIG. 8B is a plan diagram of the ink chamber unit shown in FIG. 4B;

DETAILED DESCRIPTION OF THE PREFERRED EMBODIMENTS

Figure 1:
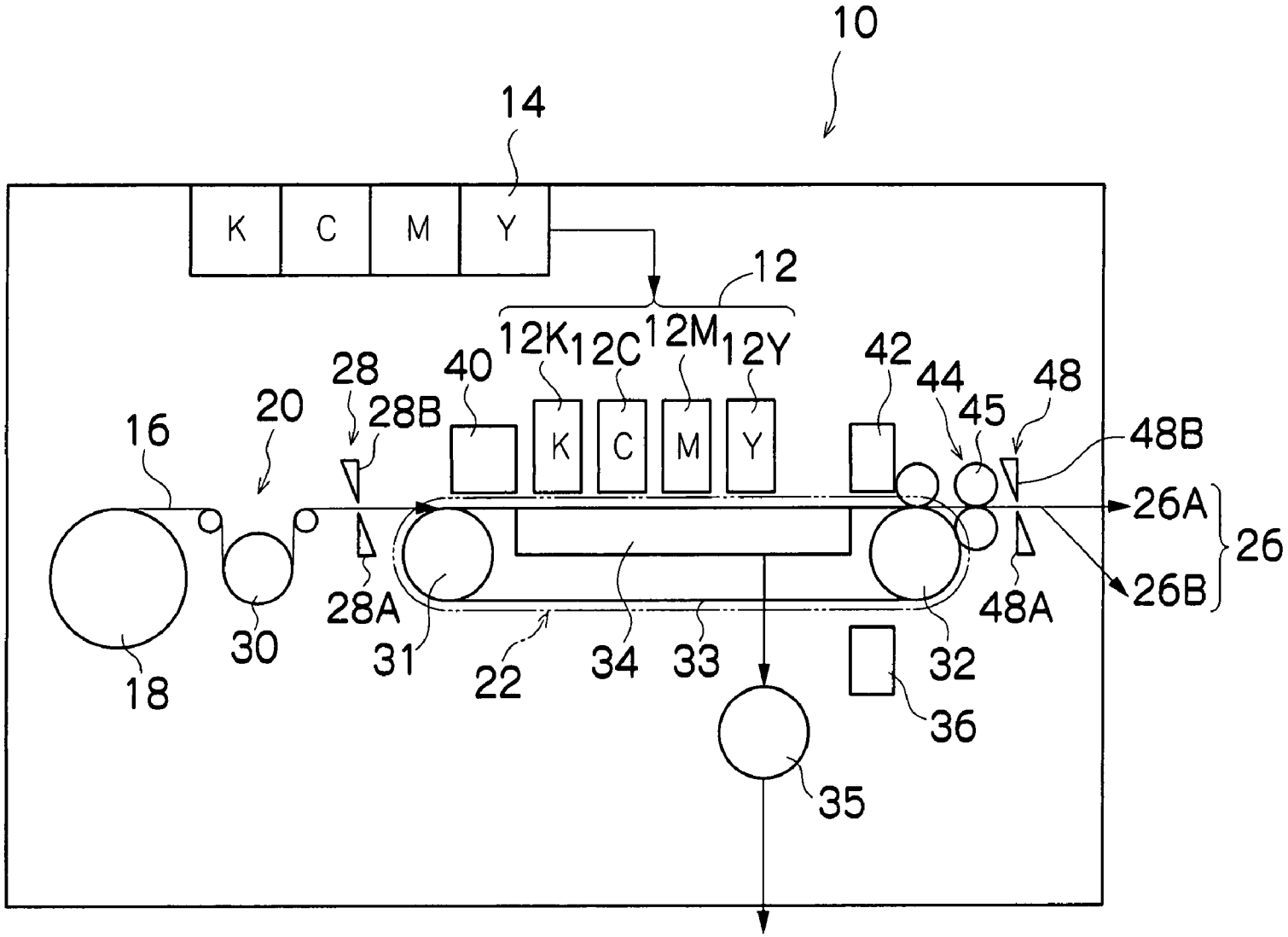
FIG. 1 is a general compositional diagram of an inkjet recording apparatus as an image forming apparatus according to an embodiment of the present invention.

FIG. 1 is a general configuration diagram of an inkjet recording apparatus as an image forming apparatus according to an embodiment of the present invention. As shown in FIG. 1, the inkjet recording apparatus 10 comprises: a printing unit 12 having a plurality of discharge heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the heads 12K, 12C, 12M, and 12Y; a paper supply unit 18 for supplying recording paper 16 which is a recording medium (discharge receiving medium); a decurling unit 20 removing curl in the recording paper 16; a suction belt conveyance unit 22 disposed facing the nozzle face (ink-droplet discharge face) of the printing unit 12, for conveying the recording paper 16 while keeping the recording paper 16 flat; and a paper output unit 26 for outputting image-printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet discharge is controlled so that the ink-droplets are discharged in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (reference numeral 88 shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
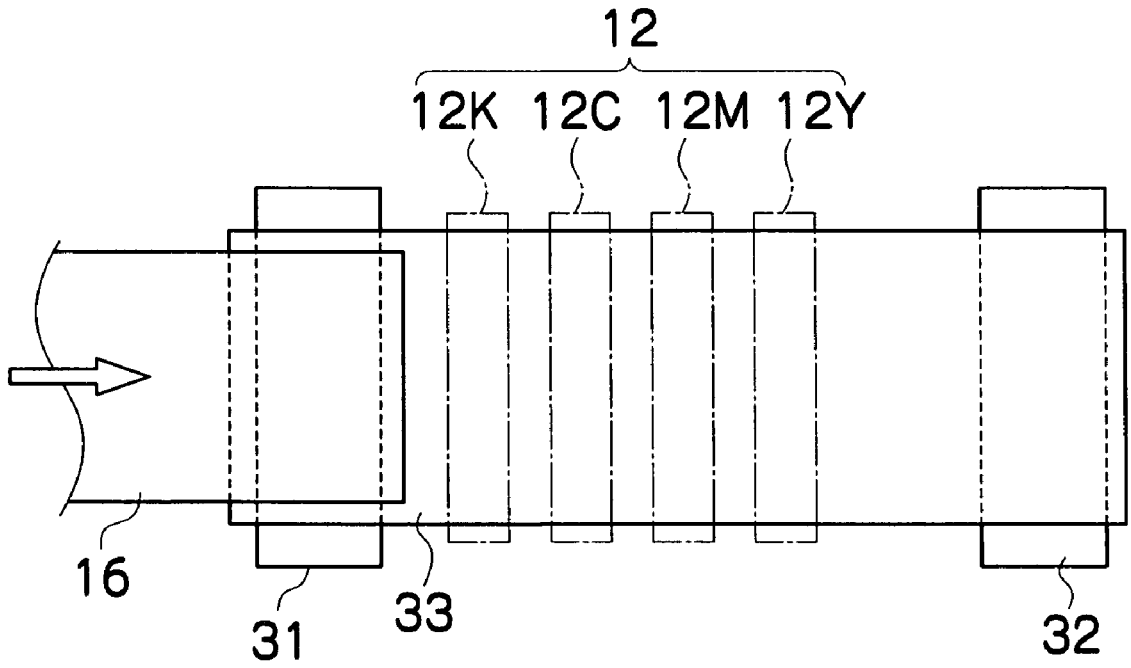
FIG. 2 is a plan view of the principal part of the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for discharging ink arranged on a nozzle face through a length exceeding at least one edge of the maximum-size recording medium (namely, the full width of the printable range), as shown in FIG. 2.

The heads 12K, 12C, 12M and 12Y are arranged in color order (black (K), cyan (C), magenta (M), yellow (Y)) from the upstream side in the feed direction of the recording paper 16, and those respective heads 12K, 12C, 12M and 12Y are fixed extending in a direction substantially perpendicular to the conveyance direction of the recording paper 16.

A color image can be formed on the recording paper 16 by discharging inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks or dark inks can be added as required. For example, a configuration is possible in which inkjet heads for discharging light-colored inks such as light cyan and light magenta are added. Furthermore, there are no particular restrictions of the sequence in which the heads of respective colors are arranged.

A post-drying unit 42 is disposed following the printing unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a head will be described. The heads 12K, 12C, 12M and 12Y of the respective ink colors have the same structure, and a reference numeral 50 is hereinafter designated to any of the heads.

Figure 3A:
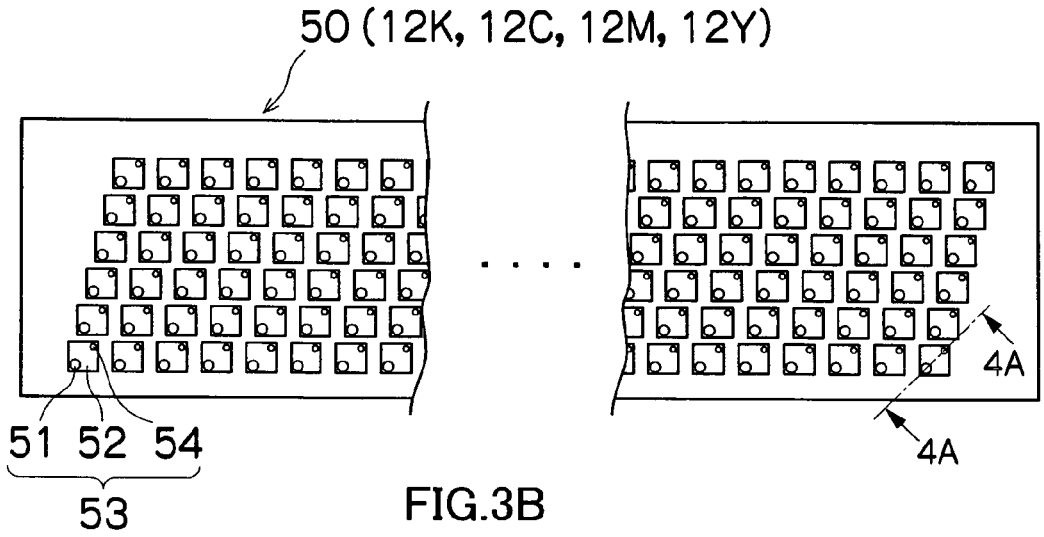
FIGS. 3A to 3C show the composition of a discharge head in the inkjet recording apparatus shown in FIG. 1.
Figure 3B:
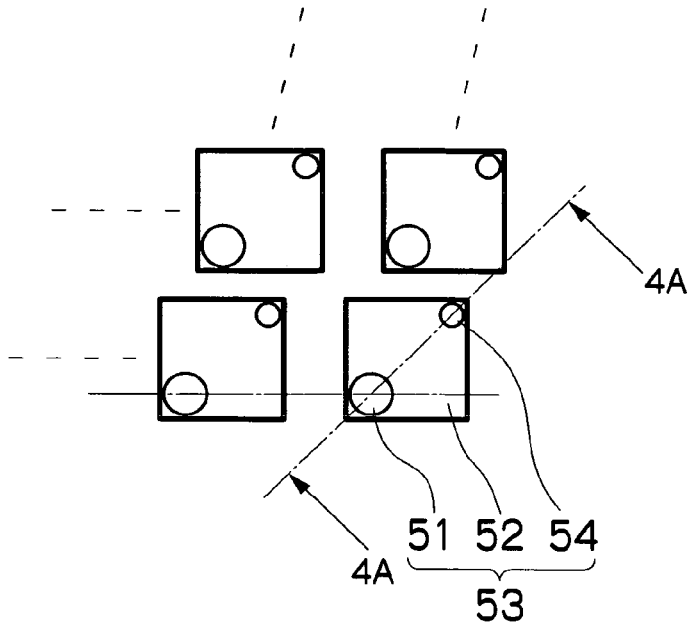
Figure 3C:
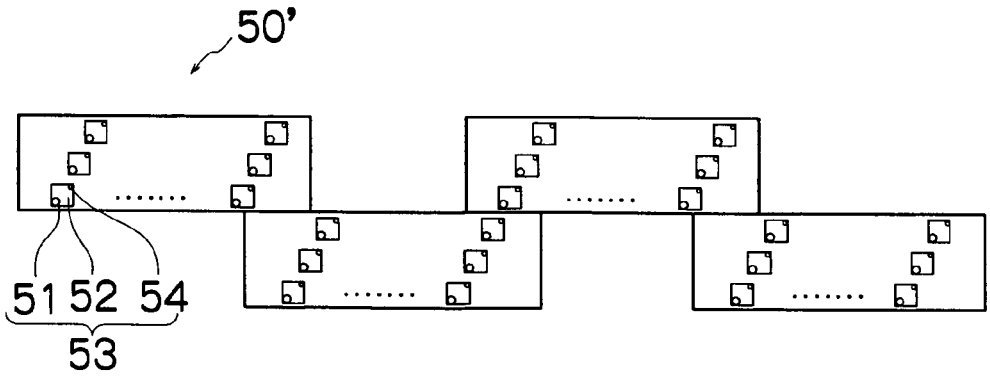
Figure 4A:
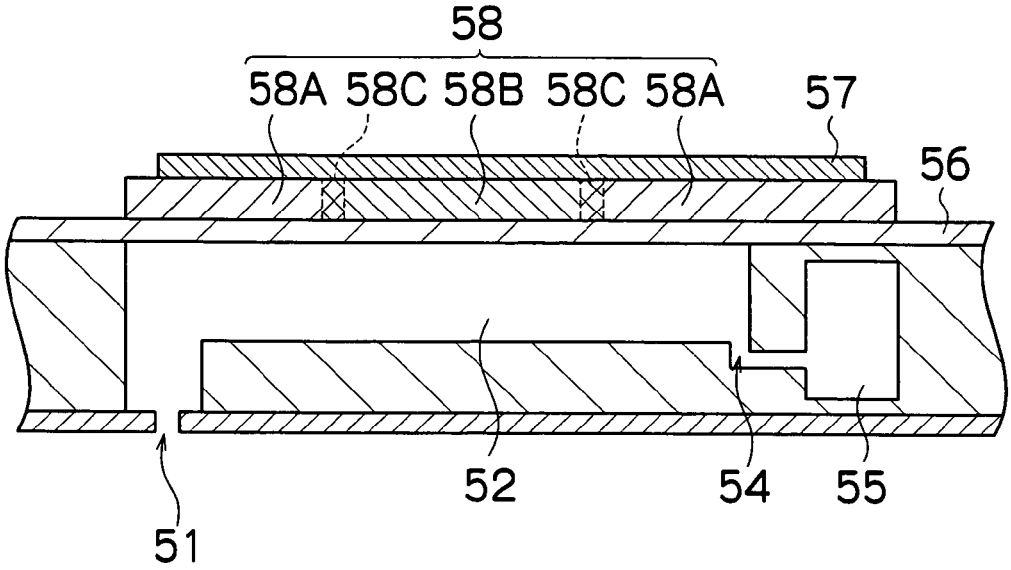
FIGS. 4A and 4B show the three-dimensional structure of the discharge head illustrated in FIGS. 3A to 3C.
Figure 4B:
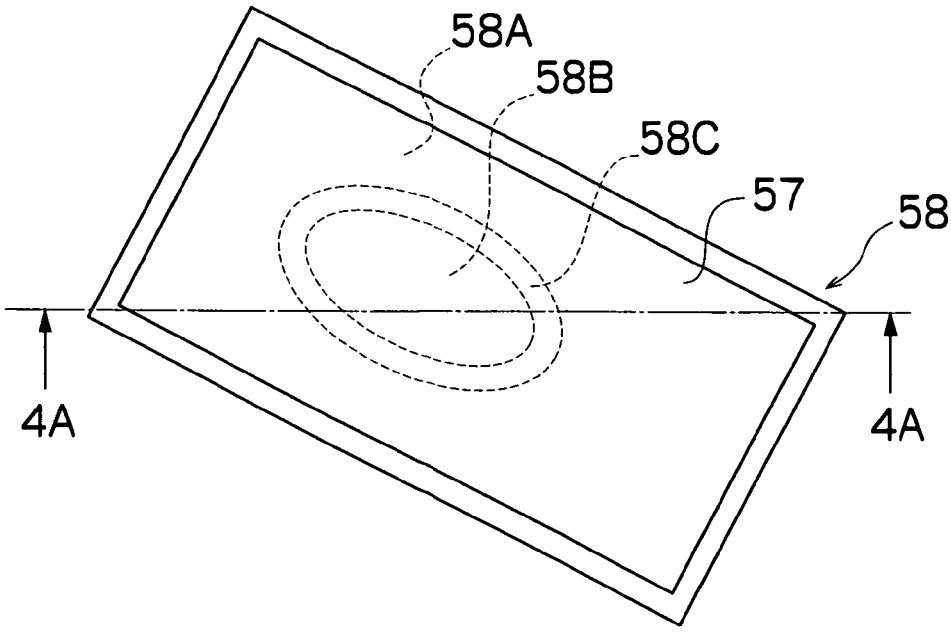

FIG. 3A is a plan view perspective diagram showing an example of the structure of a head 50, and FIG. 3B is an enlarged diagram of a portion of same. In addition, FIG. 3C is a plan view perspective diagram showing a further example of the structure of the head 50; FIG. 4A is a cross-sectional diagram showing the three-dimensional composition of one liquid droplet discharge element (an ink chamber unit corresponding to one nozzle 51), along a line 4*a*-4*a* in FIG. 3A; and FIG. 4B is a plan diagram showing the planar structure of a piezoelectric element 58. In FIG. 4B, the nozzles 51 and the supply port 54 shown in FIG. 4A are omitted.

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units 53, each comprising a nozzle (discharge aperture) 51 forming an ink droplet discharge port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode in which forms one or more nozzle rows through a length corresponding to the entire width of the recording paper 16 in a direction substantially perpendicular to the conveyance direction of the recording paper 16 is not limited to the example described above. For example, instead of the configuration in FIG. 3A, a line head having nozzle rows of a length corresponding to the entire width of the recording paper 16 can be formed by arranging and combining, in a staggered matrix, short head blocks 50' having a plurality of nozzles 51 arrayed in a two-dimensional fashion, as shown in FIG. 3C.

The planar shape of the pressure chamber 52 provided corresponding to each nozzle 51 is a rectangle, an approximate square, an approximate diamond, or the like. The nozzle 51 and an inlet for supplying ink (supply port) 54 are disposed at respective corners on a diagonal line of the planar shape. FIGS. 3A, 3B and 3C show pressure chambers 52 which are approximately square in shape, but the pressure chambers 52 may also have a rectangular shape, as shown in FIG. 4B. Furthermore, besides those, it is also possible to adopt a polygonal shape other than a quadrilateral shape, such as a triangular shape. Moreover, it is also possible to apply a chamfer (radius or curve processing) to the vertex regions of the pressure chambers 52.

As shown in FIG. 4A, each pressure chamber 52 is connected to a common channel 55 via the supply port 54. The common channel 55 is connected to an ink tank (not shown in FIG. 4A, but indicated by reference numeral 60 in FIG. 6), which is a base tank that supplies ink, and the ink supplied from the ink tank is delivered through the common channel 55 shown in FIG. 4A to the pressure chambers 52.

A piezoelectric element 58 provided with an individual electrode 57 is bonded to a diaphragm 56 which also serves as a common electrode, and which forms the ceiling of the pressure chamber 52. The piezoelectric elements 58 according to the present embodiment are formed so as to have local differences in characteristics.

More specifically, the piezoelectric element 58 comprises: a drive piezoelectric body section (first piezoelectric body section) 58A which is made of a first constituent material; a determination piezoelectric body section (second piezoelectric body section) 58B which is made of a second constituent material; and an intermediate piezoelectric body section (third piezoelectric body section) 58C which is made of a third constituent material that combines the first constituent material and the second constituent material.

As shown in FIG. 4B which is a plan view perspective diagram of a piezoelectric element 58 from the side of the individual electrode 57, the drive piezoelectric body section 58A, the determination piezoelectric body section 58B, and the intermediate piezoelectric body section 58C are distributed unevenly within a plane that is substantially parallel to the diaphragm 56. The drive piezoelectric body section 58A is provided so as to surround the perimeter of the determination piezoelectric body section 58B. The intermediate piezoelectric body section 58C which has a graduated structural composition which changes composition gradually (continuously), is provided in the boundary region between the drive piezoelectric body section 58A and the determination piezoelectric body section 58B.

A material forming a piezoelectric element having excellent drive characteristics, namely, high absolute values for the equivalent piezoelectric constant (d constant, electromechanical conversion coefficient, piezoelectric distortion constant), is used for the first constituent material. A material forming a piezoelectric element having excellent determination characteristics, namely, high voltage output coefficient (g constant, mechanical-electrical conversion coefficient, piezoelectric stress coefficient), is used for the second constituent material.

The drive piezoelectric body section 58A made of the first constituent material generates a discharge pressure which is applied to the ink in response to a drive signal. The drive piezoelectric body section 58A principally functions in respect of driving ink discharge. Furthermore, the piezoelectric body section 58B made of the second constituent material generates a voltage in accordance with the pressure applied to the ink. The piezoelectric body section 58B principally functions in respect of determining the pressure of the pressure chamber 52.

More specifically, if a drive voltage is applied to the individual electrode 57, the diaphragm 56 deforms in accordance with the distortion that occurs in the piezoelectric element 58 (principally, the drive piezoelectric body section 58A), and the volume of the pressure chamber 52 changes. Due to the pressure change caused by this change in the volume of the pressure chamber, ink is discharged from the nozzle 51. When ink is discharged, new ink is supplied to the pressure chamber 52 from the common channel 55 through the supply port 54.

On the other hand, if the diaphragm 56 receives a pressure from the ink inside the pressure chamber 52 (namely, if the diaphragm 56 receives the pressure of the pressure chamber 52), then a distortion is produced in the piezoelectric element 58 in response to this pressure (principally, in the determination piezoelectric body section 58B), and a voltage corresponding to this distortion is generated in the individual electrode 57. The pressure (or pressure variation) in the pressure chamber 52 can be determined from the voltage generated in the individual electrode 57, and the presence or absence of a discharge abnormality in the nozzle 51 of the pressure chamber 52 can be judged from the pressure of the pressure chamber 52 thus determined. The details relating to the determination of a discharge abnormality described above are described hereinafter.

In general, a ceramic material is suitable for the first constituent material. One example of a ceramic material is lead zirconate titanate ($Pb(Zr—Ti)O_3$), basically composed of lead titanate ($PbTiO_3$) which is a ferroelectric material and lead zirconate ($PbZrO_3$) which is an antiferroelectric material. By changing the ratio in which those two components are combined, it is possible to control various properties of the ceramic material, such as the piezoelectric, dielectric, and elastic characteristics. Therefore, it is possible to obtain a piezoelectric ceramic material having better ink discharge efficiency and pressure determination efficiency.

Furthermore, a fluoride resin type material, such as PVDF (Polyvinylidene fluoride) or PVDF-TrFE (Polyvinylidene fluoride-Trifluoride ethylene copolymer) is suitable for the second constituent material.

Figure 5:
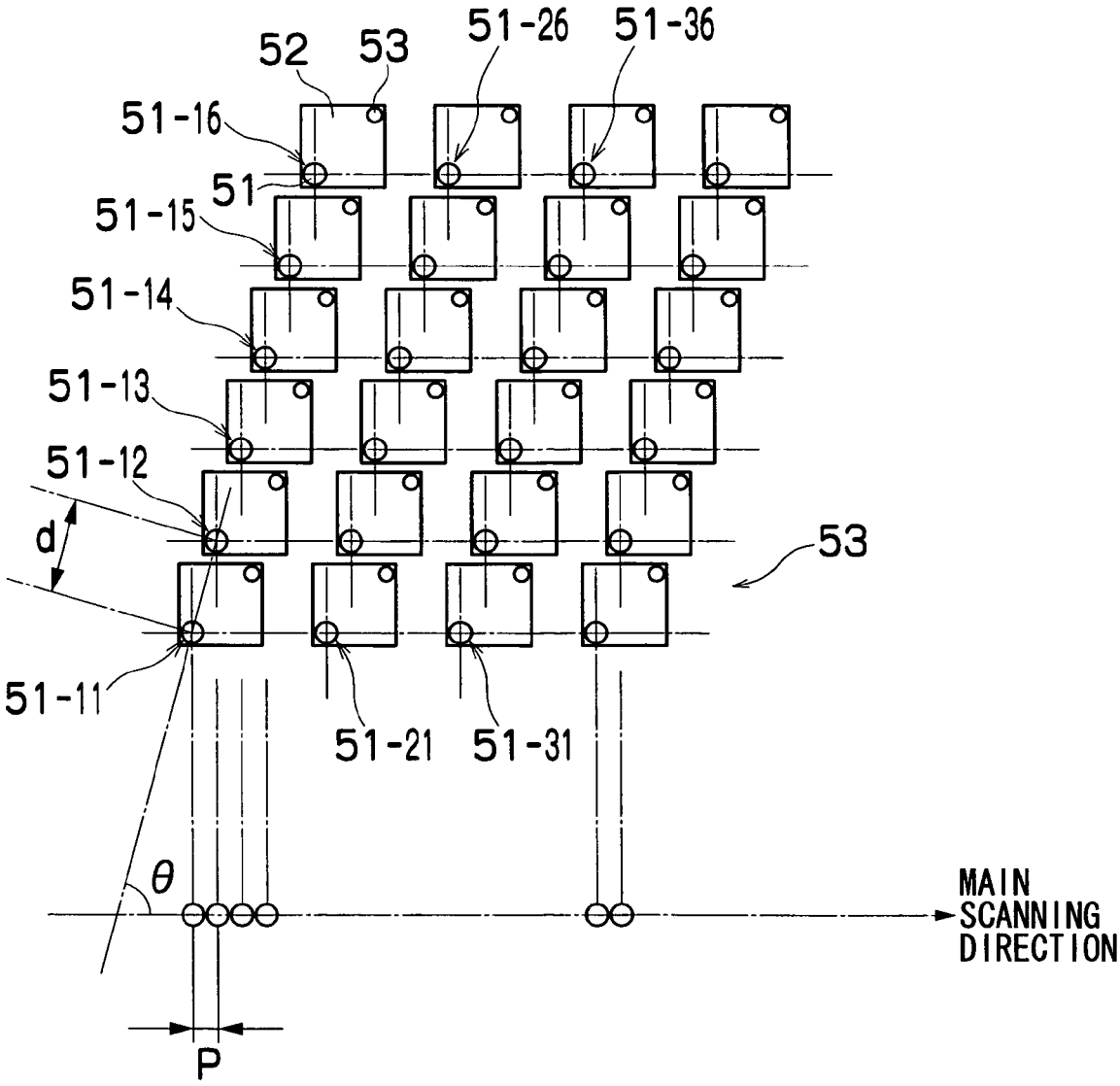
FIG. 5 is an enlarged view of a nozzle arrangement in the discharge head shown in FIGS. 3A to 3C.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Configuration of an Ink Supply System

Figure 6:
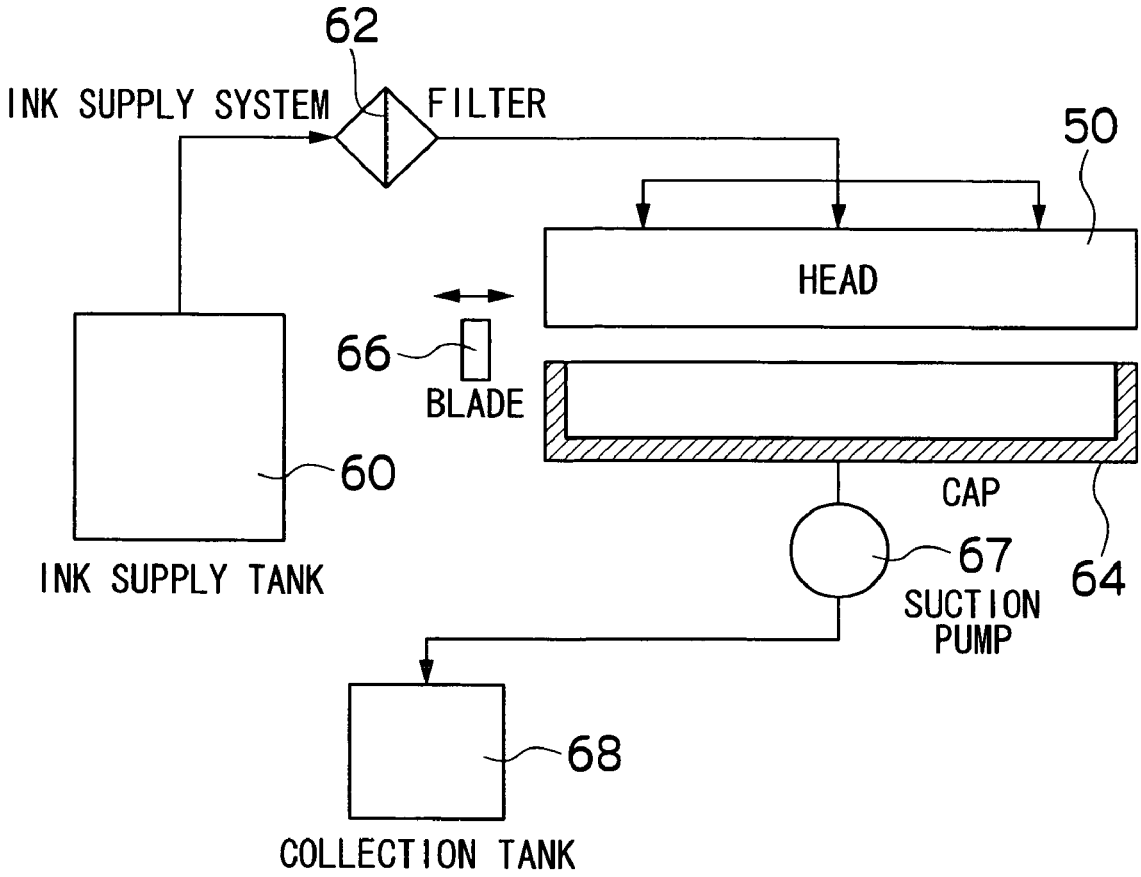
FIG. 6 is a schematic drawing showing the composition of an ink supply system in the inkjet recording apparatus according to the embodiment.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform discharge control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the head 50 or nearby the head 50. The sub-tank has a damper function for preventing variation in the internal pressure of the head and a function for improving refilling of the head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink discharge surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not discharged from the head 50 continues for a certain amount of time or longer, the ink solvent in the vicinity of the nozzles 51 evaporates and ink viscosity increases. In such a state, ink can no longer be discharged from the nozzle 51 even if the piezoelectric element 58 for the discharge driving is operated. Before reaching such a state (in a viscosity range that allows discharge by the operation of the piezoelectric element 58) the piezoelectric element 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzle 51 even if the piezoelectric element 58 is operated. Also, when the ink viscosity inside the nozzle 51 has increased over a certain level, ink can no longer be discharged from the nozzle 51 even if the piezoelectric element 58 is operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
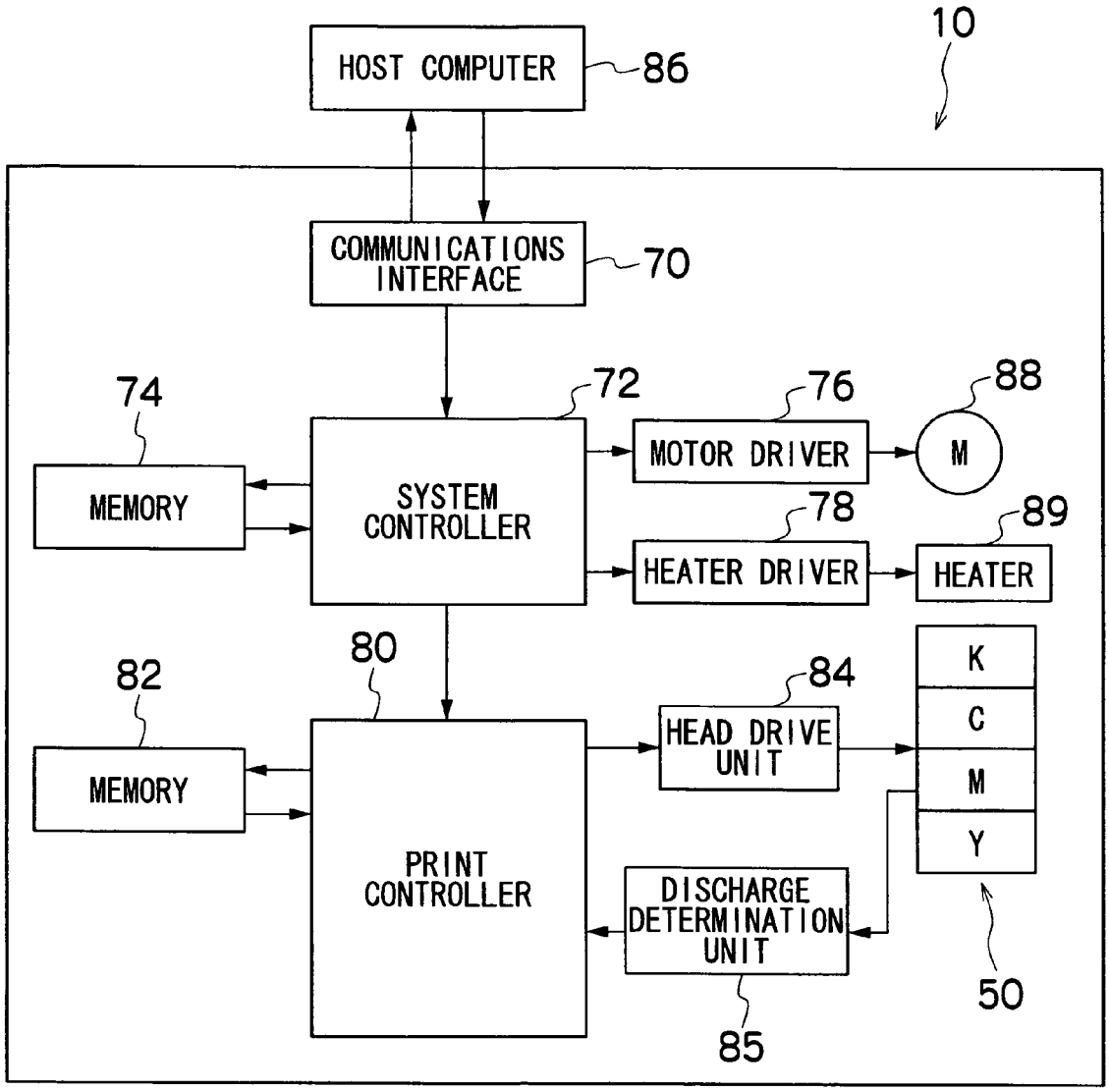
FIG. 7 is a principal block diagram showing the system composition of the inkjet recording apparatus according to the embodiment.

FIG. 7 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, a memory 82, a head drive unit 84, a discharge determination section 85, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, and the like, as well as controlling communications with the host computer 86 and writing and reading to and from the memory 74, and it also generates control signals for controlling the motor 88 and heater 89 of the conveyance system.

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print data (dot data) to the head drive unit 84. Prescribed signal processing is carried out in the print controller 80, and the discharge amount and the discharge timing of the ink droplets from the respective heads 50 are controlled via the head drive unit 84, on the basis of the print data. By this means, prescribed dot size and dot positions can be achieved.

The print controller 80 is provided with the memory 82; and image data, parameters, and other data are temporarily stored in the memory 82 when image data is processed in the print controller 80. The aspect shown in FIG. 7 is one in which the memory 82 accompanies the print controller 80; however, the memory 74 may also serve as the memory 82. Also possible is an aspect in which the print controller 80 and the system controller 72 are integrated to form a single processor.

The head drive unit 84 drives the piezoelectric elements 58 of the heads of the respective colors 12K, 12C, 12M and 12Y according to print data supplied by the print controller 80. The head drive unit 84 can be provided with a feedback control system for maintaining constant drive conditions for the heads.

The image data to be printed is externally inputted through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the memory 82.

The head drive unit 84 generates drive control signals for the head 50 on the basis of the dot data stored in the memory 82. By supplying the drive control signals generated by the head drive unit 84 to the head 50, ink is discharged from the head 50. By controlling ink discharge from the heads 50 in synchronization with the conveyance velocity of the recording paper 16, an image is formed on the recording paper 16.

The discharge determination section 85 is a signal processing section which performs prescribed signal processing with respect to the voltage (determination signal) that corresponds to the pressure variation in the pressure chamber 52 determined by the piezoelectric element 58 shown in FIGS. 4A and 4B (principally, the determination piezoelectric body section 58B). The determination signal that has undergone signal processing by the discharge determination section 85 is sent to the print controller 80, and the presence or absence of an abnormality in the nozzle 51 of the corresponding pressure chamber 52, or of a discharge abnormality caused by the occurrence of a gas bubble, or the like, inside the pressure chamber 52, is determined.

Drive Control and Pressure Determination Control in Piezoelectric Element

Next, drive control of the above-described piezoelectric element 58, and control of pressure determination (discharge abnormality determination) using the piezoelectric element 58 will be described in detail.

Figure 8A:
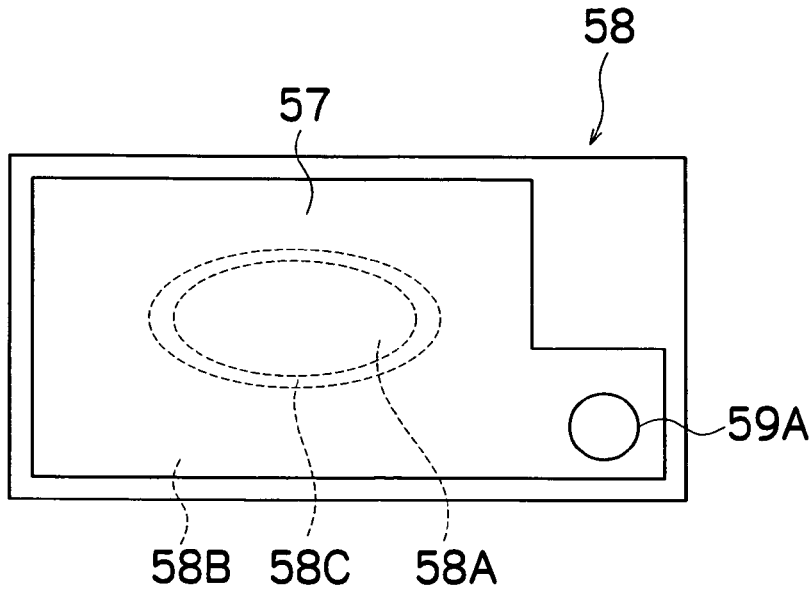
FIGS. 8A and 8B show the structures of an individual electrode provided on the piezoelectric element illustrated in FIGS. 4A and 4B.

FIG. 8A is a plan view of the ink chamber unit 53 illustrated in FIG. 4A, as viewed from the side of the individual electrode 57.

Figure 8B:
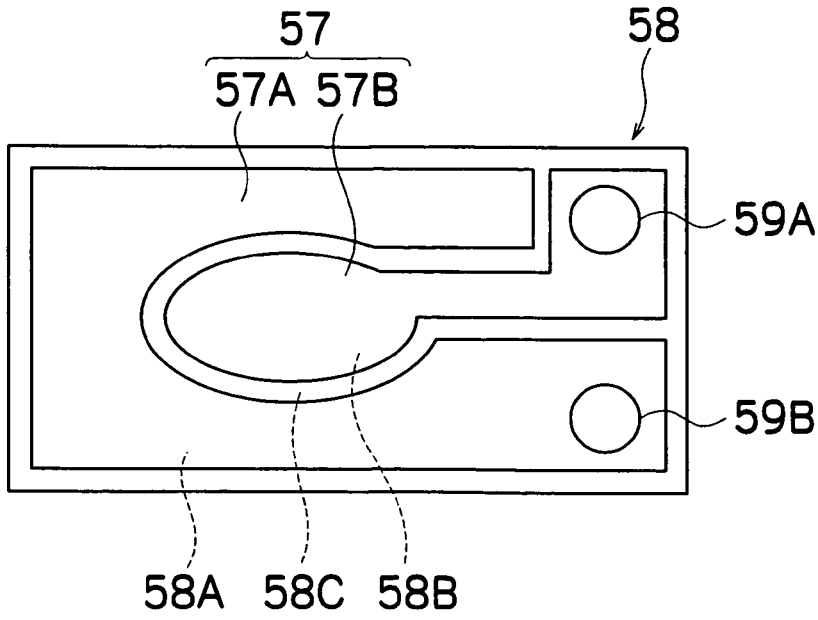
Figure 9:
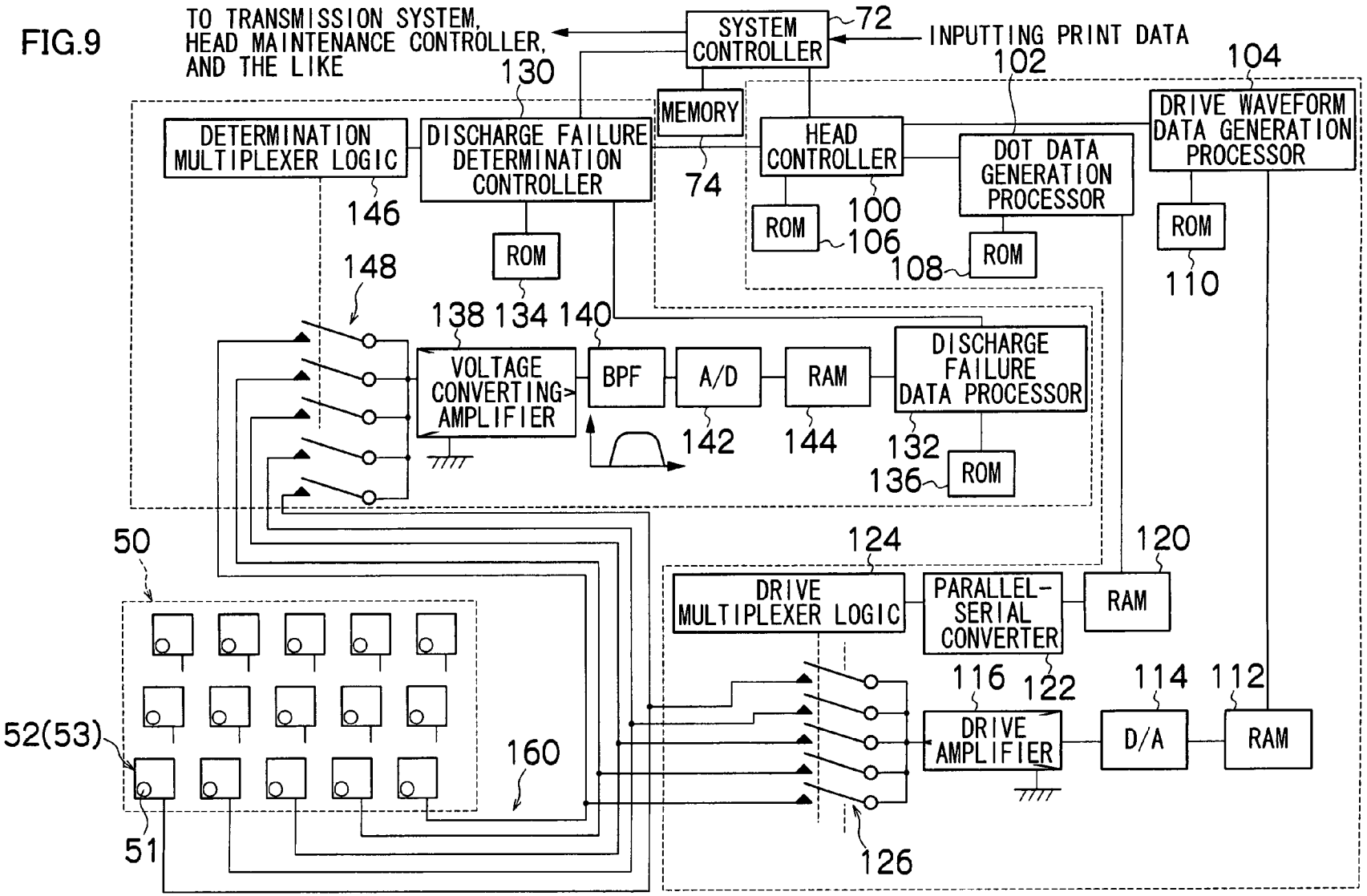
FIG. 9 is a detailed block diagram of the system composition shown in FIG. 7.

The individual electrode 57 has a structure in which the drive piezoelectric body section 58A and the determination piezoelectric body section 58B are connected by a common electrode (one metal thin film), and a drive signal and a determination signal are transmitted from the electrode extraction section 59 using a common signal wire (not illustrated in FIGS. 8A and 8B, and indicated by reference numeral 160 in FIG. 9).

Certainly, as shown in FIG. 8B, it is also possible to adopt a structure in which a drive individual electrode 57A which applies a drive signal to the drive piezoelectric body section 58A, and a determination individual electrode 57B which extracts a determination signal from the determination piezoelectric body section 58B, are provided separately, the drive signal being applied to the drive individual electrode 57A from the head drive unit 84, via a drive signal wire and the electrode extraction section 59A, and the determination signal being applied to the discharge determination section 85 from the determination individual electrode 57B, via the electrode extraction section 59B and a determination signal wire.

Furthermore, if the drive individual electrode and the determination individual electrode are constituted by a common individual electrode 57 and the drive signal and determination signal are transmitted via a common signal wire, then it is possible to reduce the number of wires, thus contributing to the high density of the head. On the other hand, as shown in FIG. 8B, in a composition that a drive individual electrode 57A and a determination individual electrode 57B are provided separately, it is not necessary to provide a circuit for separating the determination signal from the signal wire, and hence the electrical system and the control system can be simplified.

Herein, the determination signal is a signal which is obtained from the piezoelectric element 58 when the piezoelectric element 58 (the determination piezoelectric body section 58B) is functioning as a pressure sensor for determining the pressure of the pressure chamber 52, and is a determination signal which corresponds to the change in the ink pressure when driving for discharge or driving for determining discharge abnormality is performed by the piezoelectric element 58 (drive piezoelectric body section 58A) during ink discharge.

More specifically, the determination signal is an impedance change signal which corresponds to the state of resonance (resonance frequency) and response determined by the (change) value of the ink pressure, or the properties of the nozzle 51, pressure chamber 52, supply port 54, common channel 55, piezoelectric element 58, ink, and the like.

FIG. 9 is a detailed block diagram of the head drive unit 84 and discharge determination unit 85 shown in FIG. 7. In FIG. 9, items which are the same as or similar to those in FIG. 7 are labeled with the same reference numerals and description thereof is omitted here.

In the inkjet recording apparatus 10, the head drive unit 84 comprises a head controller 100, dot data generation processor 102, drive waveform data generation processor 104, ROMs 106, 108 and 110 forming recording device provided respectively in these units, a RAM 112 which temporarily stores a drive waveform generated by the drive waveform data generation processor 104, a D/A converter 114, a drive amp 116, a RAM 120 forming a temporary storage region for the dot data generated by the dot data generation processor 102, a parallel-serial converter 122, a drive multiplex logic 124, a switch circuit 126, and the like.

In addition, the discharge determination unit 85 comprises a discharge failure determination controller 130, a discharge failure data processor 132, a discharge failure determination controller 130, ROMs 134 and 136 which are recording devices provided in the discharge failure determination controller 130 and the discharge failure data processor 132, a voltage converting amplifier section 138, a bandpass filter (BPF) 140, an A/D converter 142, a RAM 144 forming a temporary storage region for a determination signal that has been subjected to signal processing, a determination multiplex logic 146, a switch circuit 148, and the like.

The processor, the controller and the like shown in FIG. 9 may be integrated into one or two or more devices, by using a single-chip microcomputer, MPU, or the like.

Additionally, the memories such as the ROM and the RAM, may be constituted by dividing up regions within the same device.

According to the present embodiment, in a head 50 in which pressure chambers 52 are arranged in a matrix configuration as illustrated in FIGS. 3A to 3C, the individual electrode to which a drive signal is applied and the individual electrode from which a determination signal is extracted are constituted by a common individual electrode 57 as shown in FIG. 8A, and the individual electrodes 57 are connected to a head drive unit 84 and a discharge determination unit 85 via a common signal wire 160. Although not shown in the drawings, there is also a mode in which a flexible substrate is used for wiring from the head 50 to the control system.

Herein, the flexible substrate used for the signal wire 160 is illustrated in a state of being formed by copper wiring which is formed on a resin sheet, polyimide, or the like. The wiring may be formed on either the front surface or the rear surface of the resin sheet, or it may be formed on both the front and rear surfaces thereof.

In FIG. 9, in order to simplify the illustration, the head 50 is shown in an arrangement of pressure chambers 52 (ink chamber units 53) having nozzles 51 aligned in three columns respectively in each one of five rows, but in practice, the greater number of pressure chambers 52 than that shown in FIG. 9 is arranged.

Signal wires 160 are connected to each of the pressure chambers 52 in order to send a drive signal to the piezoelectric elements 58 (drive piezoelectric body sections 58A, not shown in FIG. 9, but shown in FIG. 4A) of the respective pressure chambers 52 so as to eject ink, and these signal wires 160 are switched by a switching circuit 126 which is controlled by a drive multiplexer logic 124.

When a drive signal is applied to a piezoelectric element 58 provided at a pressure chamber 52, principally, the drive piezoelectric body section 58A of the piezoelectric element 58 is driven and an ink discharge operation is performed from the pressure chamber 52 (nozzle 51).

During this above operation, the pressure generated inside the pressure chamber 52 is received principally by the determination piezoelectric body section 58B of the piezoelectric element 58, and a determination signal corresponding to this pressure is generated in the individual electrode 57. In this way, the determination signal obtained from the determination piezoelectric body section 58B can be extracted from each respective pressure chamber by switching the switching circuit 148 that is controlled by the determination multiplexer logic 146.

Incidentally, when determining discharge abnormalities, the drive piezoelectric body sections 58A of the respective pressure chambers 52 may perform driving for pressure determination to a level which does not eject ink, by using a discharge abnormality determination drive waveform (drive signal), so that the ink pressure generated accordingly in the ink inside the pressure chamber 52 is determined by means of a determination piezoelectric body section 58B.

Herein, a "discharge abnormality determination waveform" is a waveform which drives the drive piezoelectric body section 58A of the pressure chamber 52 to a level which does not cause ink to be discharged from the nozzle 51, in order to determine a discharge abnormality, separately from normal ink discharge. A discharge abnormality is determined by determining the consequent ink pressure by means of the determination piezoelectric body section 58B. In this way, the discharge abnormality determination waveform is a waveform suitable for determining discharge abnormalities, which does not cause an ink discharge operation to occur. Preferably, the discharge abnormality determination waveform should be a waveform that is different to the drive waveform applied when discharging ink, and one suitable example of a waveform of this kind is a sinusoidal waveform having a frequency which resonates with the size of gas bubbles that have a high probability of entering into the pressure chamber 52 and affecting discharge. Alternatively, the discharge abnormality determination waveform may be added to a step-shaped or impulse-shaped waveform, in such a manner that the response of the whole pressure chamber 52 can be determined.

The system controller 72 receives print data for text, images, or the like, from an external source, and respectively controls the head controller 100, the discharge failure determination controller 130, and other controllers not shown in FIG. 9, such as a conveyance controller which controls the conveyance of the recording paper 16, or a head maintenance controller which controls restoration processing in the event that a discharge abnormality has occurred in the head, so as to control the printing process.

The head controller 100 instructs the dot data generation processor 102 to generate print dots according to the commands and data supplied by the system controller 72, as well as instructing the drive waveform data generation processor 104 to generate a drive waveform for ink discharge.

In addition, the head controller 100 sends a notification received from the dot data generation processor 102 regarding the piezoelectric elements 58 which drive the pressure chambers 52 at which a discharge abnormality determination operation is to be performed, to the discharge failure determination controller 130, and it also instructs the dot data generation processor 102 to change the generated dots on the basis of discharge abnormality information received from the discharge failure determination controller 130.

The drive waveform data generation processor 104 generates a plurality of drive waveforms for driving the piezoelectric elements 58 (drive piezoelectric body sections 58A) in order to generate dots of respective sizes, to determine discharge abnormalities, to perform maintenance operations, and to prevent evaporation of ink at the nozzle surface, in accordance with the instructions from the head controller 100, as well as the temperature and humidity conditions, and the media conditions, and the like.

This drive waveform data is stored in the RAM 112 and the drive waveform data is converted from digital to analogue by the D/A converter 114 in accordance with a prescribed clock signal. The converted drive waveform data is amplified to a prescribed voltage by the drive amplifier 116, and then supplied to the drive piezoelectric body section 58A of the pressure chamber 52 that is to be driven, by switching of the switch circuit 126.

The dot data generation processor 102 generates dot arrangement information from text information and/or image information, in accordance with instructions from the head controller 100. The dot data thus generated is accumulated in the RAM 120. Since the dot data accumulated in the RAM 120 is converted from parallel data to serial data by the parallel-serial converter 122, a larger amount of data can be supplied to a point near the piezoelectric elements 58 by means of a smaller number of signal wires. Furthermore, in accordance with the prescribed clock signal, the switching circuit 126 is switched by the drive multiplexer logic 124 in synchronism with the waveform data, in such a manner that the drive waveform is sent to the piezoelectric elements 58 (drive piezoelectric body sections 58A) of the respective pressure chambers 52.

The discharge failure determination controller 130 receives a determination signal from a pressure chamber of the discharge abnormality so as to perform a discharge abnormality determination operation, according to an instruction from the system controller 72 and the information relating to the pressure chambers 52 at which a discharge abnormality determination operation is to be performed, as received from the head controller 100. When determining a discharge abnormality, the discharge failure determination controller 130 notifies the head controller 100 of the discharge abnormality.

The determination signal obtained in this manner is switched via the switching circuit 148 by the determination multiplexer logic 146 which is controlled by the discharge failure determination controller 130, and the voltage of the signal is successively converted and amplified by the voltage converting amplifier unit 138, whereupon the low-frequency noise component is eliminated by a bandpass filter 140 and is unwanted high-frequency components which coincide with the sampling frequency of the A/D conversion are also eliminated. Furthermore, after analogue to digital conversion by the A/D converter 142, the signal is accumulated in a memory (RAM) 144.

The discharge failure data processor 132 processes the data accumulated in the memory 144 so as to judge whether or not there is a state which is giving rise a discharge abnormality. Consequently, if a nozzle 51 is discovered in a state that gives rise to a discharge abnormality, then this result is transmitted to the discharge failure determination controller 130.

When ink is not discharged, the discharge abnormality determination in the present embodiment may also be carried out during ink droplet discharge for forming an image, but it can also be performed by driving the piezoelectric element 58 in such a manner by using a discharge abnormality determination waveform.

In this case, when the dot data generation processor 102 decides the pressure chambers 52 (nozzles 51) at which a discharge abnormality determination operation is to be performed from the information relating to the dot arrangement (the operational states of the nozzles 51 of the respective pressure chambers 52), it reports same to the head controller 100, and a dot that is not discharged, according to the discharge abnormality determination waveform generated by the drive waveform data generation processor 104, is created in accordance with an instruction from the head controller 100.

Here, FIGS. 10A to 10D show each example of a determination signal obtained by the discharge abnormality determination described above.

Figure 10A:
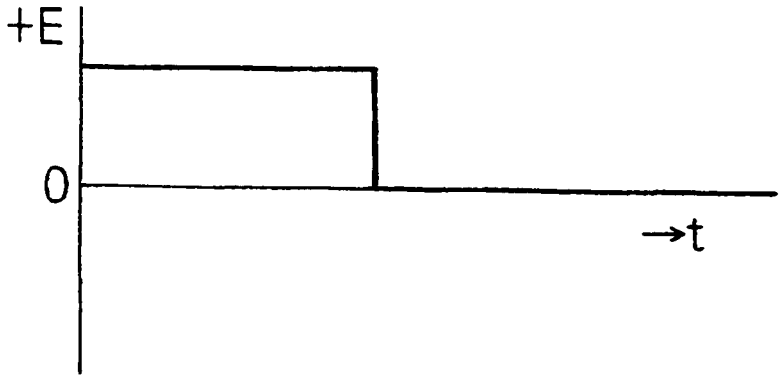
FIGS. 10A to 10D show examples of discharge abnormality determination used in the inkjet recording apparatus according to the embodiment.
Figure 10B:
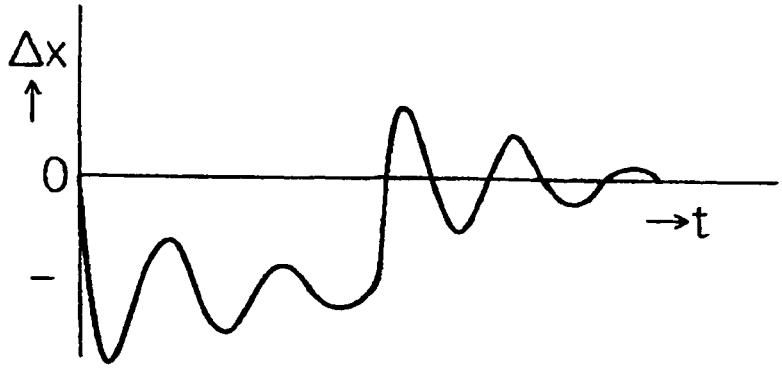
Figure 10C:
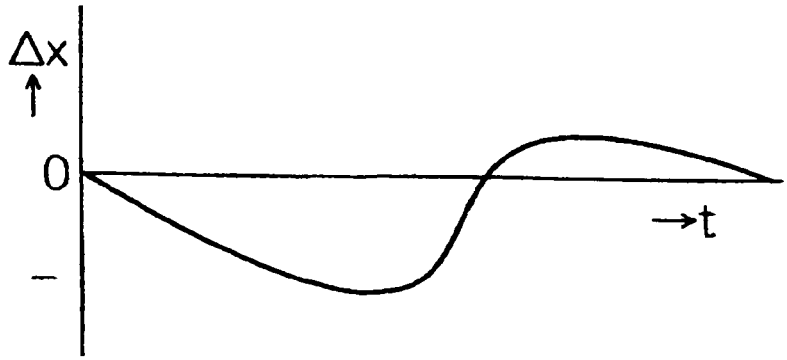
Figure 10D:
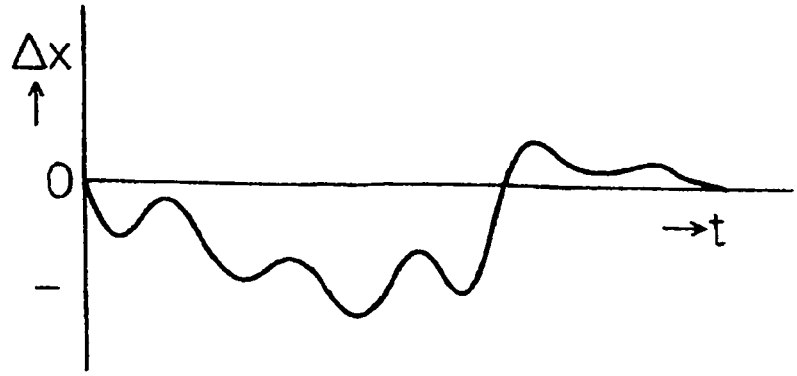

FIG. 10A is a waveform of the electrical signal, in other words, a waveform of the voltage, inputted to the piezoelectric element 58. FIGS. 10B, 10C and 10D indicate the displacement $\Delta x$ of the diaphragm 56 corresponding to each the pressure state in the pressure chamber 52.

FIG. 10B shows displacement of the diaphragm 56 in a normal state that the pressure chamber 52, nozzle 51, and common channel 55 are filled with ink in which no air is mixed. FIG. 10C shows the displacement of the diaphragm 56 in a case in which only air and no ink has been filled into the pressure chamber 52 due to a blockage on the supply side, or the like. Furthermore, FIG. 10D shows the displacement of the diaphragm 56 in a case in which there is ink inside the pressure chamber 52, but air is also mixed in the pressure chamber 52. In the case of FIG. 10D, the gas bubbles produced by the mixed air act as a damper, which absorbs the vibration, and the applied pressure is not transmitted correctly to the ink, and ink cannot be discharged properly.

As described above, it is possible to determine the presence or absence of a discharge abnormality at a nozzle 51 of a pressure chamber 52 by determining the pressure change in the pressure chamber 52 when the piezoelectric element 58 is driven.

Method for Manufacturing Piezoelectric Element

Next, the method of manufacturing the piezoelectric element 58 described above will be described below.

As shown in FIG. 4A, the piezoelectric element 58 contained in the head 50 according to the present embodiment has a laminated structure in which thin films are layered together to form nozzles 51, pressure chambers 52, supply ports 54, and the like. In the present embodiment, aerosol deposition (hereinafter, called "AD") is employed as a method for manufacturing a laminated body in which a plurality of thin layers are laminated together in this way.

Figure 11:
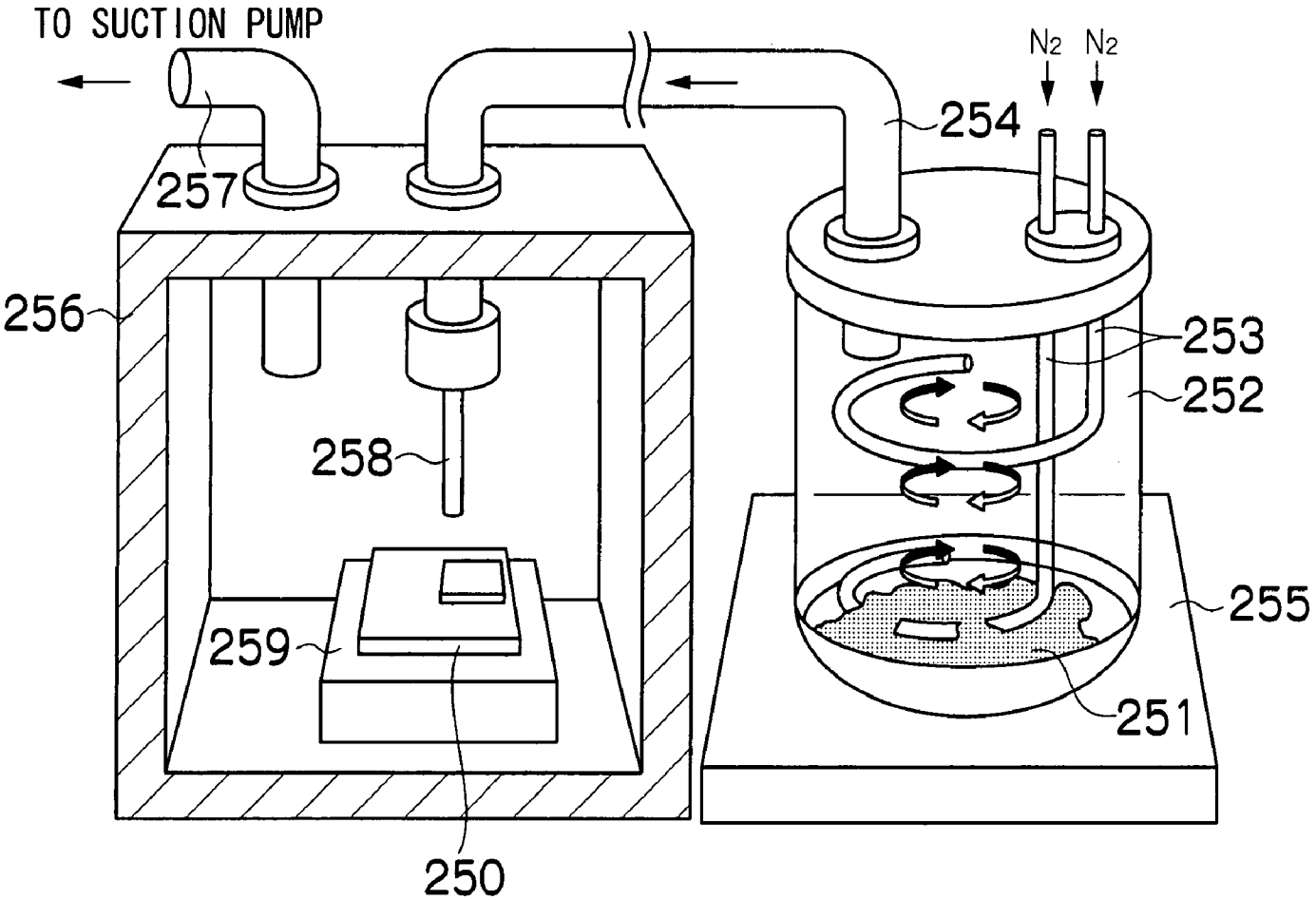
FIG. 11 is a schematic drawing showing a film formation device according to an AD method.

FIG. 11 is a schematic drawing of a film formation device according to an AD method. This film formation device has an aerosol generating chamber 252 which accommodates a raw material powder 251. Herein, an "aerosol" refers to fine particles of a solid or liquid which are suspended in a gas.

The aerosol generating chamber 252A comprises a carrier gas input section 253, an aerosol output section 254, and a vibrating unit 255. An aerosol is generated by introducing a gas, such as nitrogen gas ($N_2$), via the carrier gas input section 253 and thus blowing and lifting the raw material powder that is accommodated in the aerosol generating chamber 252. At this time, since a vibration to the aerosol generating chamber 252 is applied by the vibrating unit 255, the raw material powder is churned up and an aerosol is generated efficiently. The aerosol thus created is channeled through the aerosol output section 254 to a film formation chamber 256.

The film formation chamber 256 comprises an exhaust tube 257, a nozzle 258, and a movable stage 259. The exhaust tube 257 is connected to a vacuum pump, and evacuates the interior of the film formation chamber 256. The aerosol generated in the aerosol generating chamber 252 and conducted to the film formation chamber 256 via the aerosol output section 254 is sprayed from the nozzle 258 onto a substrate 250. In this way, the raw material powder collides with and builds up on the substrate 250. The substrate 250 is mounted on a movable stage 259 that is capable of three-dimensional movement, and hence the relative positions of the substrate 250 and the nozzle 258 can be adjusted by controlling the movement of the movable stage 259.

In the aforementioned AD method, a graduated structural composition is formed by adjusting the components of the aerosol that is sprayed from the nozzle 258 while moving the movable stage 259 back and forth in the direction in which the composition of the piezoelectric element 58 is to be changed. By using the AD method in this way, it is possible to manufacture a piezoelectric element having a structure in which the composition changes continuously as shown in FIG. 4A.

When changing the composition continuously in this way, an intermediate piezoelectric body section 58C is formed as illustrated in FIG. 4A.

The piezoelectric element 58 having this intermediate piezoelectric body section 58C is able to prevent the occurrence of fractures, such as joint faults in joint sections, that arise due to the distortion produced in the boundary regions when driving a piezoelectric element 58 formed by simply aligning and joining (bonding) two piezoelectric elements of different properties.

More specifically, the intermediate piezoelectric body section 58C contributes to an alleviation of such the internal stress. Therefore, incorporating such an intermediate piezoelectric body section 58C contributes beneficially to the lifespan of the piezoelectric element 58.

For example, it is preferable to form an intermediate piezoelectric body section 58C forming a section of graduated composition in the case in which a piezoelectric element 58 having the structure shown in FIG. 4A is formed using two constituent materials having different characteristics, for instance, a ceramic material is used as the first constituent material and a fluoride resin material is used as the second constituent material.

On the other hand, the intermediate piezoelectric body section 58C may be omitted in the case in which two constituent materials having the same or similar characteristics are joined together.

Furthermore, since fluoride resin materials have weak thermal properties, a piezoelectric element 58 which use a fluoride resin material, such as PVDF, is preferably manufactured using an AD method which does not involve processing at high temperatures.

Moreover, the individual electrodes 57 and common electrodes (which also serve as diaphragms 56 in the present embodiment) may also be formed by the AD method. Of course, the individual electrodes 57 and common electrodes may also be formed by vapor deposition, sputtering, or the like.

It is beneficial to form the individual electrodes 57 by the AD method in the case in which a plurality of individual electrodes are to be formed in the same surface as shown in FIG. 8B (in the present embodiment, a drive individual electrode 57A and a determination individual electrode 57B).

In the present embodiment, the AD method is used to manufacture the piezoelectric elements 58, but it is also possible to manufacture all or a portion of the ink chamber units 53, such as the pressure chambers 52, the nozzle plate formed with nozzles 51, and the diaphragm 56, by the AD method.

The method of manufacturing the piezoelectric elements 58 described in the present embodiment is not limited to the AD method, and various other thin film manufacturing methods, such as sputtering or vapor deposition, or thin film bonding methods, can be employed.

Structural Example of Piezoelectric Element

Next, the composition of a piezoelectric element 58 used in the present example will be described in detail.

As described previously, the piezoelectric element 58 used in the head 50 comprises a region that has excellent ink discharge drive characteristics (drive piezoelectric body section 58A) and a region having excellent properties for determining the pressure in the pressure chamber 52 (determination piezoelectric body section 58B), constituent material matching those respective characteristics being used respectively in each region.

In other words, the piezoelectric element 58 has excellent characteristics (conversion efficiency) in terms of both ink discharge drive characteristics and pressure chamber pressure determination characteristics, and therefore has a structure suitable for a head that is integrated to a high density.

In a piezoelectric element 58 having the aforementioned structure, the distribution of the different characteristic materials is determined by the properties and dimensional restrictions governed by the design of the inkjet head, the properties of the ink used, and the like.

Figure 12:
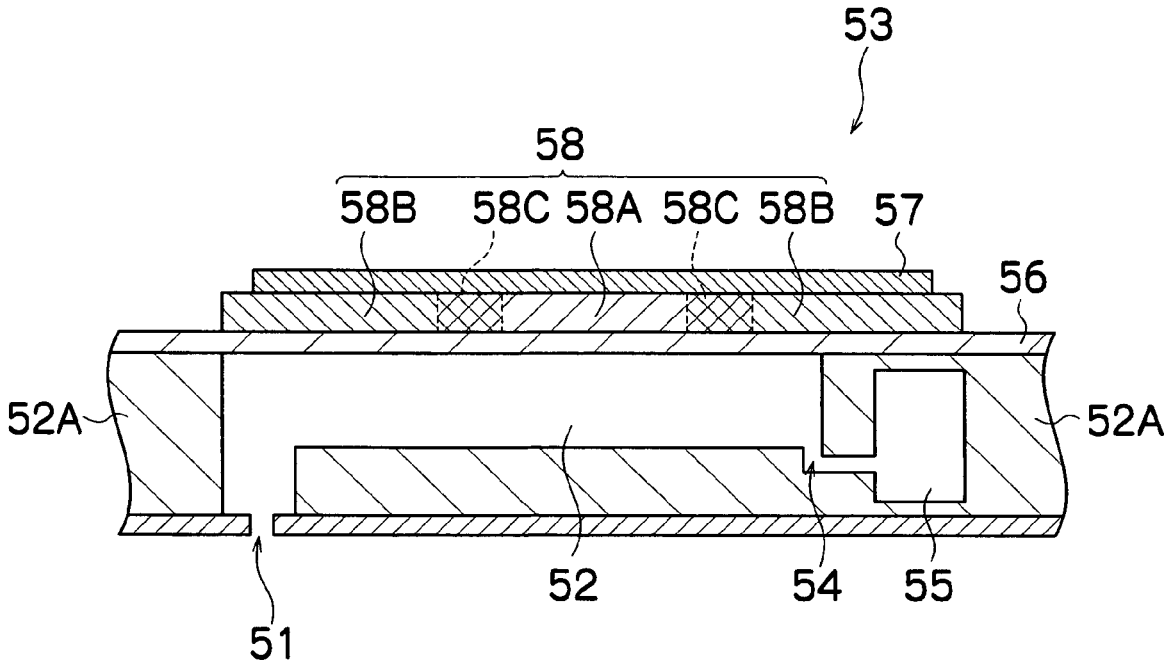
FIG. 12 is a cross-sectional diagram showing a further mode of the piezoelectric element shown in FIGS. 4A and 4B.

FIG. 12 shows a further mode of a piezoelectric element 58 composed by distributing the two constituent materials shown in FIG. 4A, unevenly, within a surface that has a perpendicular component with respect to the thickness direction of the piezoelectric element 58 (a surface that is substantially parallel to the diaphragm 56). In FIG. 12, items which are the same as or similar to those in FIG. 4A are labeled with the same reference numerals and description thereof is omitted here.

In the piezoelectric element 58 shown in FIG. 12, a determination piezoelectric body section 58B made of a second constituent material is provided so as to surround a drive piezoelectric body section 58A made of a first constituent material. In the boundary section between the drive piezoelectric body section 58A and the determination piezoelectric body section 58B, an intermediate piezoelectric body section 58C is provided in a graduated structural composition which changes composition gradually (continuously).

More specifically, the piezoelectric element 58 shown in FIG. 12 has a structure in which the determination piezoelectric body section 58B made of the second constituent material, which is a material having a large piezoelectric output coefficient, is arranged in the shape of a donut on the periphery (edge section) of the diaphragm 56. In the piezoelectric element 58 shown in FIG. 12, the arrangement positions of the drive piezoelectric body section 58A and the determination piezoelectric body section 58B are reversed in comparison with the piezoelectric element 58 shown in FIG. 4A. In those respective modes, the ink discharge drive characteristics relating to the pressure chamber 52 are different to the pressure determination characteristics relating to the pressure chamber 52.

The pressure chamber 52 shown in FIG. 12 has a structure on the periphery of the diaphragm 56 (i.e. the diaphragm 56 in the vicinity of the pressure chamber wall 52A), whereby the diaphragm 56 does not deform readily when it is displaced (deformed), in other words, a structure that does not readily allow displacement, due to the high resistance to deformation of the pressure chamber wall 52A. However, this region that is not readily deformed does transmit the pressure received by the diaphragm 56, and therefore the edge portion of the diaphragm 56 is suitable for determining the pressure of the pressure chamber 52.

Moreover, the pressure in the pressure chamber 52 should be determined by arranging the determination piezoelectric body section 58B in the vicinity of the nozzle 51 which increases the effects of a discharge abnormality, such as a discharge failure, and in the vicinity of the supply port 54 which increases the effects of ink replenishment.

In other words, it is preferable that the pressure inside the pressure chamber 52 is determined in the vicinity of the nozzle 51 and in the vicinity of the supply port 54, in which the pressure wave propagating through the pressure chamber 52 is largest.

In the mode shown in FIG. 12, a piezoelectric element which determines pressure by means of displacement in the $g_{33}$ direction (compressive distortion) (principally, a piezoelectric element which determines pressure according to the stress occurring in a substantially perpendicular direction to the diaphragm 56) should be used as the determination piezoelectric body section 58B. Herein, displacement in the $g_{33}$ direction indicates a substantially perpendicular direction to the pressure determination surface, and hence, the force applied in the direction substantially perpendicular to the determination surface is evaluated. In general, since a piezoelectric element which determines pressure by means of displacement in the $g_{33}$ direction has high determination efficiency, it is suitable for use in the case in which only a relatively small pressure is obtained.

Figure 13:
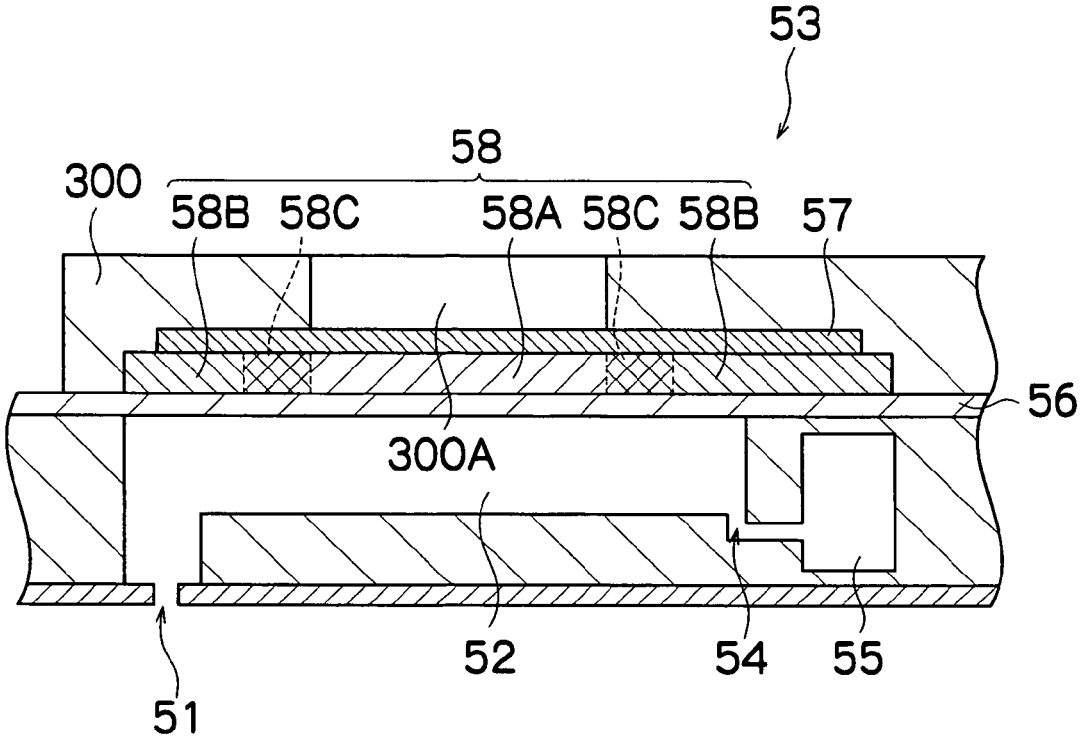
FIG. 13 is a cross-sectional diagram of a discharge element (ink chamber unit) provided with the piezoelectric element shown in FIG. 12.

Furthermore, if a piezoelectric element using displacement in the $g_{33}$ direction is employed as the determination piezoelectric body section 58B, a displacement restricting member 300 having a prescribed rigidity, which prevents the determination piezoelectric body section 58B from being displaced upwards or downwards in FIG. 13 due to the internal pressure of the pressure chamber 52, should be provided on the opposite side of the determination piezoelectric body section 58B with respect to the diaphragm 56, as shown in FIG. 13.

In this way, since the displacement restricting member 300 is provided on the side of the determination piezoelectric body section 58B opposite to the side which receives pressure, the determination piezoelectric body section 58B is pressed from the opposite side to the side which receives pressure so as to restrict the upward or downward displacement of the determination piezoelectric body section 58B in FIG. 13, and hence the distortion of the determination piezoelectric body section 58B can be increased.

More specifically, if the piezoelectric element used for the determination piezoelectric body section 58B has low rigidity and relatively small thickness so as to determine pressure by means of displacement in the $g_{33}$ direction, then a composition is preferably adopted in which the piezoelectric element is fixed by a member of high rigidity on the side opposite to the side which receives pressure.

On the other hand, the displacement restricting member 300 has a cavity section 300A in the portion above the drive piezoelectric body section 58A. This cavity section 300A prevents restricting member 300 from restricting the displacement of the drive piezoelectric body section 58A. Therefore, by providing the cavity section 300A in the displacement restricting member 300, it is possible to preserve the ink discharge pressure generated by the drive piezoelectric body section 58A, preferably.

The cavity section 300A may be a through aperture (opening) as shown in FIG. 13, or it may be a recess section provided in the displacement restricting member 300 on the side adjacent to the piezoelectric element 58 (a pit shape facing downward in FIG. 13). Furthermore, the portion where the cavity section 300A is provided may also be constituted by a low-rigidity section which does not restrict the displacement of the piezoelectric element 58.

On the other hand, in the mode shown in FIG. 4A, a piezoelectric element which determines pressure principally by means of displacement in the $g_{31}$ direction should be used for the determination piezoelectric body section 58B. Displacement in the $g_{31}$ direction indicates displacement in the longitudinal direction which is perpendicular to the thickness direction in which the piezoelectric element receives pressure (i.e. a direction substantially parallel to the diaphragm 56). If a piezoelectric element which determines pressure by means of displacement in the $g_{31}$ direction is used, then the pressure is determined according to the $g_{31}$ distortion (compression or extension).

Figure 14:
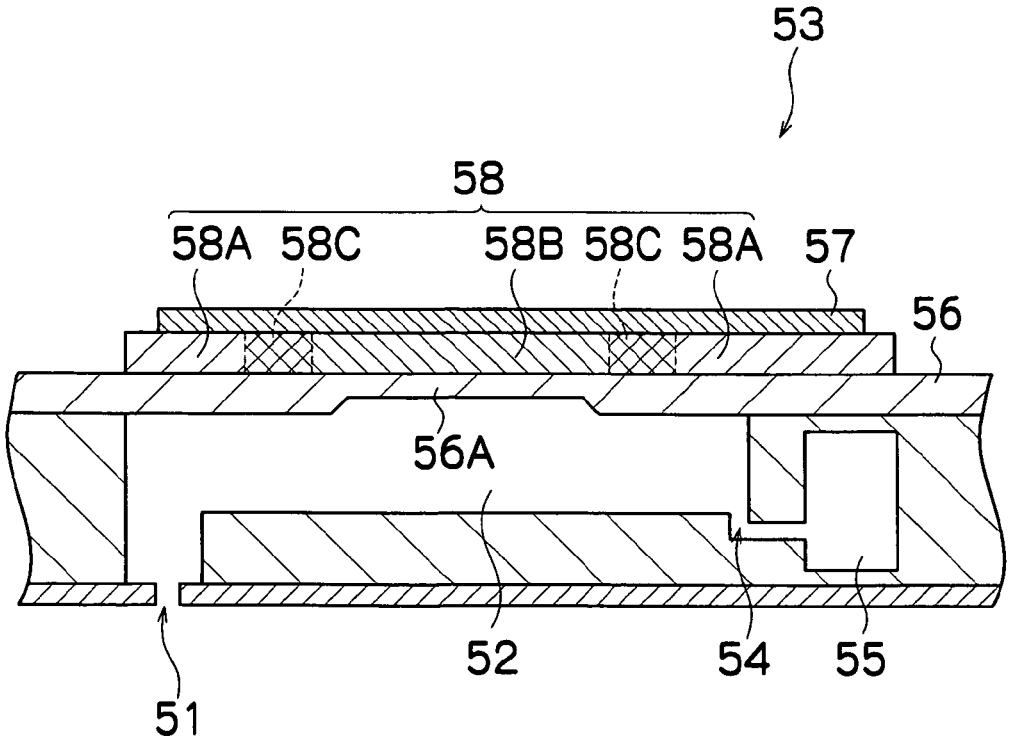
FIG. 14 is a cross-sectional diagram of a discharge element (ink chamber unit) provided with the piezoelectric element shown in FIGS. 4A and 4B.

If a large displacement is required in order to ensure a large ink discharge pressure, then a drive signal of high voltage is applied to the drive piezoelectric body section 58A, and hence a piezoelectric element having high voltage tolerance is used for the drive piezoelectric body section 58A. In such a case, a piezoelectric element which determines pressure by means of displacement in the $g_{31}$ direction should be used for the determination piezoelectric body section 58B. In addition, if a piezoelectric element which determines pressure by means of displacement in the $g_{31}$ direction is used, then it is preferable to provide a thin section 56A (low-rigidity section) in the central portion of the diaphragm 56 corresponding to the determination piezoelectric body section 58B so as to reduce the rigidity of the diaphragm 56 and increase the distortion of the determination piezoelectric body section 58B, as shown in FIG. 14. The thin section 56A provided in the diaphragm 56 has a rigidity which does not impede displacement of the determination piezoelectric body section 58B. However, if the diaphragm 56 is formed to a relatively large thickness, then the ink discharge pressure is generated by the drive piezoelectric body section 58A is lost, and therefore the thin section 56A of the diaphragm 56 needs to be formed to a thickness which does not diminish the ink discharge pressure. Preferably, the thickness of the diaphragm 56 is substantially the same as the thickness of the drive piezoelectric body section 58A.

It is also possible to provide a low-rigidity section having a rigidity which does not restrict the distortion (displacement) of the determination piezoelectric body section 58B, instead of the thin section 56A. For example, there is a mode in which a low-rigidity section made of a metallic material or resin material of lower rigidity than stainless steel is provided substantially in the central portion of a diaphragm 56 made of stainless steel (a portion corresponding to the thin section 56A in FIG. 14).

Figure 15:
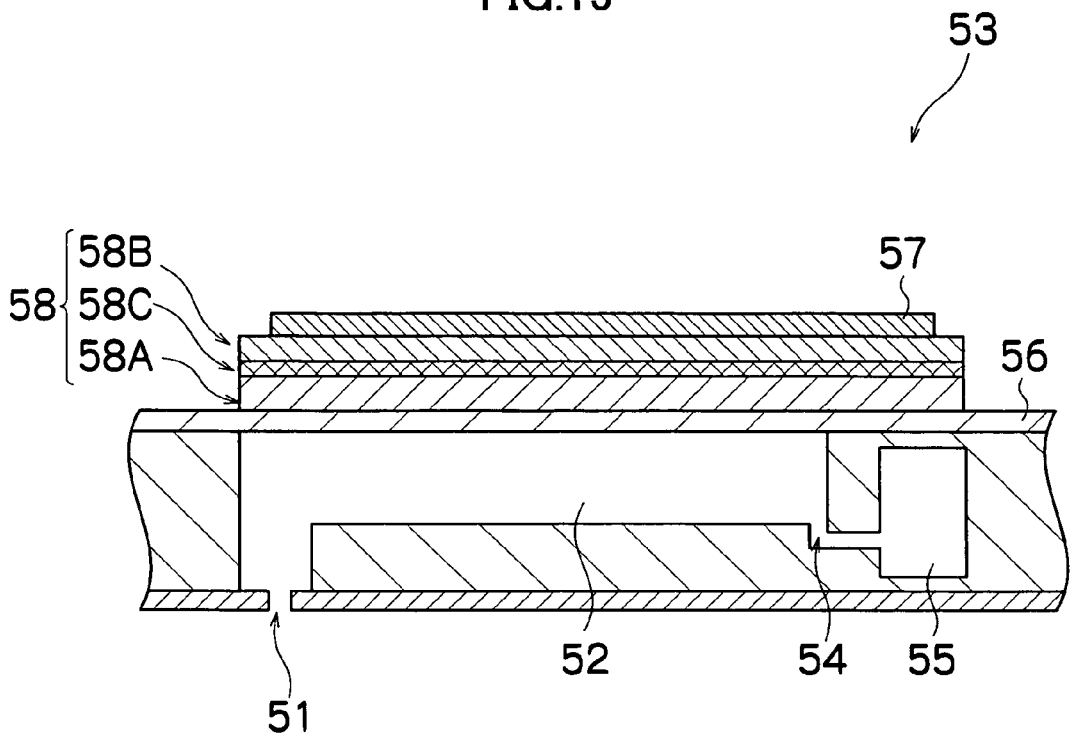
FIG. 15 is a cross-sectional diagram showing a mode of the piezoelectric element shown in FIGS. 4A and 4B.
Figure 16:
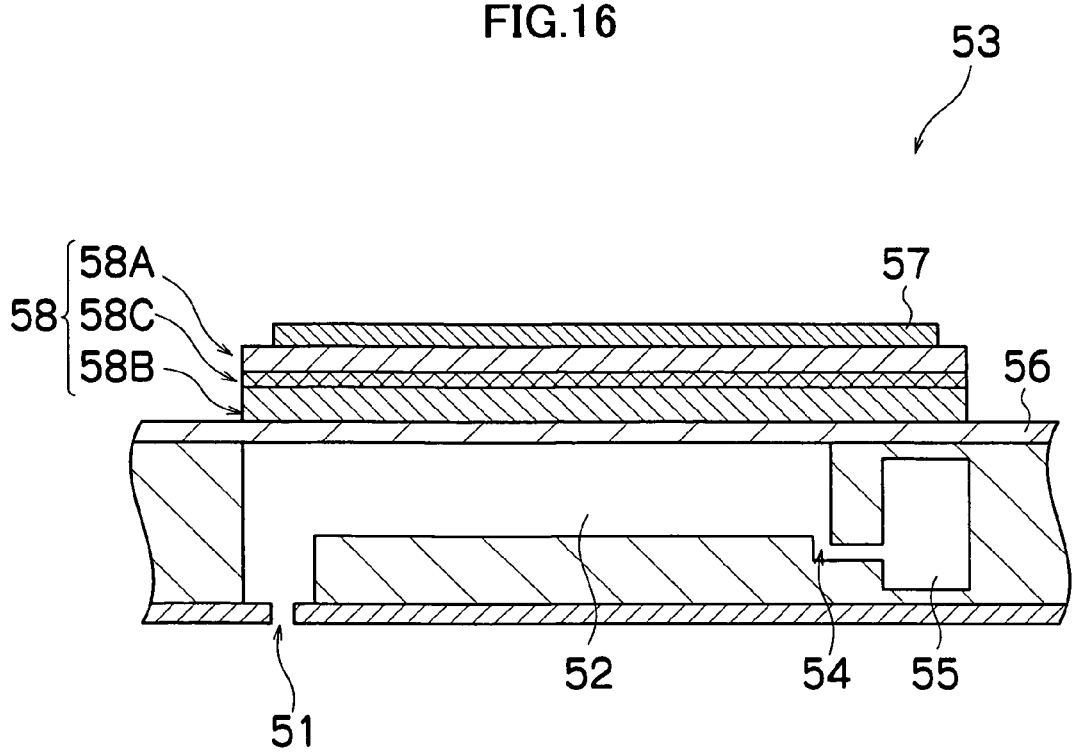
FIG. 16 is a diagram showing a further mode of the piezoelectric element shown in FIG. 4A and FIG. 4B.

Herein, as shown in FIG. 15 and FIG. 16, the drive piezoelectric body section 58A and the determination piezoelectric body section 58B may be laminated together, and then the intermediate piezoelectric body section 58C may be provided at the joint section between these sections.

The piezoelectric element 58 shown in FIG. 15 has a composition which prioritizes ink discharge pressure, and the sections are layered on the diaphragm 56 in the following order, drive piezoelectric body section 58A, intermediate piezoelectric body section 58C, and determination piezoelectric body section 58B.

On the other hand, the piezoelectric element 58 shown in FIG. 16 has a composition which prioritizes pressure determination characteristics, and the sections are layered on the diaphragm 56 in the following order, determination piezoelectric body section 58B, intermediate piezoelectric body section 58C, and drive piezoelectric body section 58A.

Figure 17:
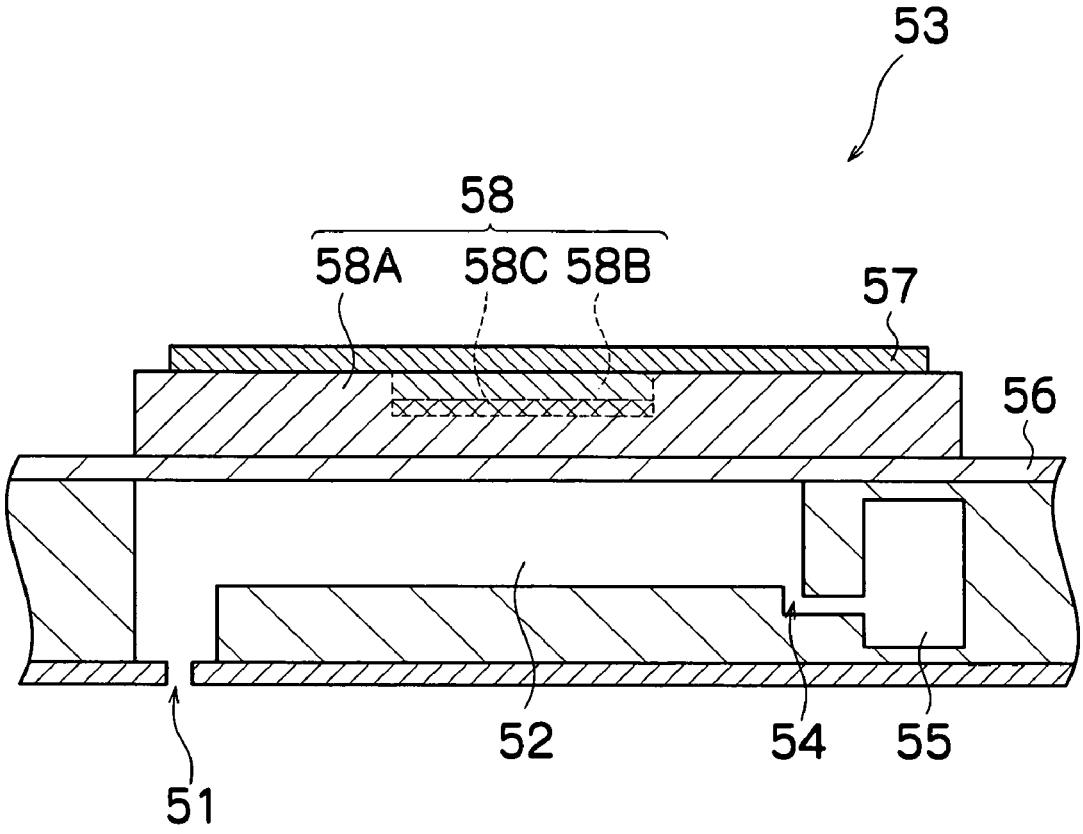
FIG. 17 is a cross-sectional diagram of a modification example of the piezoelectric element shown in FIGS. 4A and 4B.

Furthermore, as shown in FIG. 17, different constituent materials may be distributed unevenly in the thickness direction of the piezoelectric element 58 (the direction substantially perpendicular to the diaphragm 56), and in a direction substantially perpendicular to the thickness direction (the direction substantially parallel to the diaphragm 56). The piezoelectric element 58 shown in FIG. 17 has a structure in which layers on the diaphragm 56 in the order of a drive piezoelectric body section 58A, an intermediate piezoelectric body section 58C, and a determination piezoelectric body section 58B, in the central section of the piezoelectric element 58 shown in FIG. 14. The thickness of the drive piezoelectric body section 58A is approximately 1-10 μm.

In other words, the piezoelectric element 58 shown in FIG. 17 has a structure which combines the mode shown in FIG. 14 and the mode shown in FIG. 15.

By this above configuration, in the mode shown in FIG. 14, the central portion of the piezoelectric element 58, which principally contributes to the determination of pressure in the pressure chamber 52, also contributes to ink discharge. In addition, a distortion is produced in the piezoelectric element 58 whereby the diaphragm 56 is displaced in a trapezoid shape. Incidentally, the portion of the piezoelectric element 58 having a laminated structure may be formed as a layered piezoelectric element by forming electrodes between the respective layers.

More specifically, the direction in which the constituent materials are distributed within the piezoelectric element 58 is principally the planar direction thereof, but it is possible to adopt a structure in which the respective constituent materials also overlap in a layered fashion corresponding to the direction perpendicular to the planar direction.

In the inkjet recording apparatus 10 having the configuration described above, the piezoelectric element 58 forming the ink discharge device is constituted by unevenly distributing constituent materials in a direction having a perpendicular directional component with respect to the thickness direction. A first constituent material forming a drive piezoelectric body section 58A which principally contributes to ink discharge and a second constituent material forming a determination piezoelectric body section 58B which principally contributes to determining the pressure in the pressure chamber 52 (determining discharge abnormality in the nozzle 51) are distributed unevenly in the planar direction. Furthermore, the boundary region between the first constituent material and the second constituent material has a graduated structural composition in which the ratio of these constituent materials changes gradually.

Therefore, the constituent materials are distributed so as to achieve a displacement of the pressure chamber 52 and the diaphragm 56 which enables both the ink discharge performance and the pressure determination performance relating to the pressure chamber 52 to be achieved, and hence a piezoelectric element 58 suitable for high density arrangement in a head can be obtained.

In the aforementioned description, an inkjet recording apparatus has been described as one example of a liquid discharge apparatus, but the scope of the present invention is not limited to this and it may also be applied to various other types of liquid discharge apparatuses which form three-dimensional shapes on a discharge receiving medium by discharging liquid onto the discharge receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A discharge head, comprising:

a nozzle plate having a discharge aperture through which a droplet of liquid is discharged onto a discharge receiving medium;

a pressure chamber which stores the liquid discharged from the discharge aperture;

a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein:

the piezoelectric element is formed integrally by distributing a first piezoelectric body section and a second piezoelectric body section unevenly in a plane parallel to the diaphragm, and by distributing an intermediate piezoelectric body section arranged between the first and second piezoelectric body sections;

the first piezoelectric body section causes the diaphragm to deform for applying the discharge pressure to the liquid stored in the pressure chamber, the first piezoelectric body section being made of a first constituent material;

the second piezoelectric body section determines a pressure generated in the pressure chamber, the second piezoelectric body section being made of a second constituent material; and the intermediate piezoelectric body section has a structural composition which varies continuously.

2. The discharge head as defined in claim 1, wherein:

the first constituent material contains a constituent material which forms a piezoelectric body section having a high absolute value for an equivalent piezoelectric constant (d constant) compared to the second constituent material; and the second constituent material contains a constituent material which forms a piezoelectric body section having a high absolute value for a voltage output coefficient (g constant) compared to the first constituent material.

3. The discharge head as defined in claim 1, wherein the intermediate piezoelectric body section is made of a third constituent material, the intermediate piezoelectric body section containing a mixture of the first constituent material and the second constituent material.

4. The discharge head as defined in claim 1, wherein the piezoelectric element is manufactured by aerosol deposition.

5. An image forming apparatus, comprising the discharge head as defined in claim 1.

6. The image forming apparatus as defined in claim 5, further comprising a discharge abnormality judgment device which judges a discharge abnormality at the discharge aperture of the pressure chamber according to the pressure of the pressure chamber determined by the piezoelectric element.

7. The discharge head as defined in claim 1, wherein the first and second piezoelectric body sections are commonly provided with an individual electrode connected to a common signal wire.

8. The discharge head as defined in claim 1, wherein the first constituent material includes a ceramic material, and the second constituent material includes a fluoride resin material.

9. The discharge head as defined in claim 1, wherein the first piezoelectric body section performs driving for pressure determination when the second piezoelectric body section determines The pressure generated in the pressure chamber.

10. The discharge head as defined in claim 9, wherein the first piezoelectric body section performs driving for pressure determination by means of a discharge abnormality determination drive waveform which does not eject ink.

11. A discharge head, comprising:

a nozzle plate having a discharge aperture through which a droplet of liquid is discharged onto a discharge receiving medium;

a pressure chamber which stores the liquid to be discharged from the discharge aperture;

a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein:

the piezoelectric element comprises a first piezoelectric body sections, a second piezoelectric body section, and an intermediate piezoelectric body section arranged between the first and second piezoelectric body sections;

the first piezoelectric body section causes the diaphragm to deform for applying a discharge pressure to the liquid stored in the pressure chamber, the first piezoelectric body section being made of a first constituent material;

the second piezoelectric body section determines a pressure generated in the pressure chamber, the second piezoelectric body section being made of a second constituent material;

the intermediate piezoelectric body section has a structural composition which varies continuously; and one of the first and second piezoelectric body sections is disposed around a periphery of the other of the first and second piezoelectric body sections.

12. The discharge head as defined in claim 11, wherein:
the first piezoelectric body section is disposed around a periphery of the second piezoelectric body section.

13. The discharge head as defined in claim 12, wherein:
the piezoelectric element is formed integrally by distributing the first constituent material and the second constituent material unevenly in a plane parallel to the diaphragm;
the first constituent material contains a constituent material which forms a piezoelectric body section having a high absolute value for an equivalent piezoelectric constant (d constant) compared to the second constituent material; and
the second constituent material contains a constituent material which forms a piezoelectric body section having a high absolute value for a voltage output coefficient (g constant) compared to the first constituent material.

14. The discharge head as defined in claim 12, wherein the second constituent material forms a piezoelectric element which principally determines the pressure according to a stress in a direction substantially parallel to the diaphragm.

15. The discharge head as defined in claim 12, wherein the diaphragm comprises a low-rigidity section having a rigidity which prevents a displacement of the second piezoelectric body section from being impeded, the low-rigidity section being provided in a portion where the second piezoelectric body section is disposed.

16. The discharge head as defined in claim 12, wherein the first piezoelectric body section has a structure which is laminated onto a surface of the second piezoelectric body section adjacent to the pressure chamber.

17. The discharge head as defined in claim 12, wherein the intermediate piezoelectric body section is made of a third constituent material, the intermediate piezoelectric body section containing a mixture of the first constituent material and the second constituent material.

18. The discharge head as defined in claim 12, wherein the piezoelectric element is manufactured by aerosol deposition.

19. An image forming apparatus, comprising the discharge head as defined in claim 12.

20. The image forming apparatus as defined in claim 19, further comprising a discharge abnormality judgment device which judges a discharge abnormality at the discharge aperture of the pressure chamber according to the pressure of the pressure chamber determined by the piezoelectric element.

21. The discharge head as defined in claim 11, wherein:
the second piezoelectric body section is disposed round a periphery of the first piezoelectric body section.

22. The discharge head as defined in claim 21, wherein:
the piezoelectric element is formed integrally by distributing the first constituent material and the second constituent material unevenly in a plane parallel to the diaphragm;
the first constituent material contains a constituent material which forms a piezoelectric body section having a high absolute value for an equivalent piezoelectric constant (d constant) compared to the second constituent material; and
the second constituent material contains a constituent material which forms a piezoelectric body section having a high absolute value for a voltage output coefficient (g constant) compared to the first constituent material.

23. The discharge head as defined in claim 21, wherein the second constituent material forms a piezoelectric element which principally determines the pressure according to a stress in a direction substantially perpendicular to the diaphragm.

24. The discharge head as defined in claim 21, wherein the second piezoelectric body section comprises a displacement restricting member which restricts a displacement of the second piezoelectric body section, the displacement restriction member being provided on side opposite to the pressure chamber.

25. The discharge head as defined in claim 21, wherein the second piezoelectric body section is disposed in a vicinity of the discharge aperture.

26. The discharge head as defined in claim 21, further comprising a supply port which supplies the liquid from a liquid supply system to the pressure chamber, wherein the second piezoelectric body section is disposed in a vicinity of the supply port.

27. The discharge head as defined in claim 21, wherein the intermediate piezoelectric body section is made of a third constituent material, the intermediate piezoelectric body section containing a mixture of the first constituent material and the second constituent material.

28. The discharge head as defined in claim 21, wherein the piezoelectric element is manufactured by aerosol deposition.

29. An image forming apparatus, comprising the discharge head as defined in claim 21.

30. The image forming apparatus as defined in claim 29, further comprising a discharge abnormality judgment device which judges a discharge abnormality at the discharge aperture of the pressure chamber according to the pressure of the pressure chamber determined by the piezoelectric element.

31. The discharge head as defined in claim 11, wherein the first and second piezoelectric body sections are commonly provided with an individual electrode connected to a common signal wire.

32. The discharge head as defined in claim 11, wherein the first constituent material includes a ceramic material, and the second constituent material includes a fluoride resin material.

33. The discharge head as defined in claim 11, wherein the first piezoelectric body section performs driving for pressure determination when the second piezoelectric body section determines the pressure generated in the pressure chamber.

34. The discharge head as defined in claim 33, wherein the first piezoelectric body section performs driving for pressure determination by means of a discharge abnormality determination drive waveform which does not eject ink.

35. A discharge head, comprising:
a nozzle plate having a discharge aperture through which a droplet of liquid is discharged onto a discharge receiving medium;
a pressure chamber which stores the liquid discharged from the discharge aperture;
a diaphragm which deforms so as to change a volume of the pressure chamber, the diaphragm forming at least one wall of the pressure chamber; and
a piezoelectric element which causes the diaphragm to deform for applying a discharge pressure to the liquid stored in the pressure chamber, the piezoelectric element being provided on an opposite side of the diaphragm with respect to the pressure chamber, wherein:
the piezoelectric element is formed integrally by distributing a first piezoelectric body section and a second piezoelectric body section unevenly in a plane parallel to the diaphragm;
the first piezoelectric body section causes the diaphragm to deform for applying the discharge pressure to the liquid stored in the pressure chamber, the first piezoelectric body section being made of a first constituent material; and the second piezoelectric body section determines a pressure generated in the pressure chamber, the second piezoelectric body section being made of a second constituent material, wherein the first and second piezoelectric body sections are separately provided with individual electrodes.

36. A discharge head, comprising:

a nozzle plate having a discharge aperture through which a droplet of liquid is discharged onto a discharge receiving medium;

a pressure chamber which stores the liquid to be discharged from the discharge aperture;

a diaphragm which deforms so as to change a volume of the pressure chamber, the diaphragm forming at least one wall of the pressure chamber; and a piezoelectric element which causes the diaphragm to deform for applying a discharge pressure to the liquid stored in the pressure chamber, the piezoelectric element being provided on an opposite side of the diaphragm with respect to the pressure chamber, wherein:

the piezoelectric element comprises a first piezoelectric body section and a second piezoelectric body section;

the first piezoelectric body section causes the diaphragm to deform for applying a discharge pressure to the liquid stored in the pressure chamber, the first piezoelectric body section being made of a first constituent material;

the second piezoelectric body section determines a pressure generated in the pressure chamber, the second piezoelectric body section being made of a second constituent material; and one of the first and second piezoelectric body sections is disposed around a periphery of the other of the first and second piezoelectric body sections, wherein the first and second piezoelectric body sections are separately provided with individual electrodes.

* * * * *